United States Patent [19]

Balhorn

[11] 4,035,124

[45] July 12, 1977

[54] BLOCK MOLDING MACHINE

[75] Inventor: Milo G. Balhorn, Waterloo, Iowa

[73] Assignee: Old Fort International, Inc., Adrian, Mich.

[21] Appl. No.: 657,746

[22] Filed: Feb. 13, 1976

Related U.S. Application Data

[62] Division of Ser. No. 544,137, Jan. 27, 1975, Pat. No. 3,961,874.

[51] Int. Cl.[2] ..... B28B 3/04

[52] U.S. Cl. ..... 425/139; 425/141; 425/165; 425/421; 425/422; 425/424; 425/444

[58] Field of Search ..... 425/155, 165, 219, 225, 425/253–254, 258, 260, 448, 452, DIG. 118, 413, 443–444, 421–422, 424, 139, 141

[56] References Cited

U.S. PATENT DOCUMENTS

| | | | |
|---|---|---|---|
| 1,545,023 | 7/1925 | Wightman et al. | 425/253 |
| 2,492,415 | 12/1949 | Coates et al. | 425/165 |
| 2,586,210 | 2/1952 | Corwin | 425/452 |
| 2,652,613 | 9/1953 | Warren | 425/254 |
| 2,957,222 | 10/1960 | Zmania et al. | 425/155 |
| 2,961,730 | 11/1960 | Marino | 425/421 |
| 2,985,935 | 5/1961 | Wellnitz | 425/155 |
| 3,143,780 | 8/1964 | Clanton et al. | 425/254 |
| 3,264,702 | 8/1966 | Clanton et al. | 425/443 |
| 3,277,551 | 10/1966 | Sekiguchi | 425/422 |
| 3,545,053 | 12/1970 | Besser | 425/150 |

*Primary Examiner*—Francis S. Husar
*Assistant Examiner*—John McQuade
*Attorney, Agent, or Firm*—Olsen and Stephenson

[57] ABSTRACT

Apparatus for forming concrete building blocks which is constructed and arranged (1) to minimize sound emissions to the environment of a magnitude which might cause injury to the hearing of the operators, (2) to provide shielding around the major movable components of the machine so as to substantially eliminate potential causes of bodily injury to the operators, and (3) to improve the performance and cooperation of the major components for making concrete blocks. To provide shielding against noise and bodily injury, the frame of the apparatus is constructed in conjunction with sound insulation panels to provide an enclosure around the major movable components of the apparatus, and the frame also supports these components on internal surfaces thereof so as to minimize sound transmission openings to the environment. The various components, such as the feed drawer assembly, sizing and compression head assembly, strip mechanism, pallet eject and feed assembly, pallet magazine and the like, are improved and arranged to provide optimum performance not merely from sound and safety standpoint, but also to assure most favorable operation from the standpoint of cycle-time, trouble-free operation, ease of servicing and the like.

8 Claims, 26 Drawing Figures

394
8
396
400
410
452
412
414
390
7
392
450
418
447
430
428
421
422
424
426
456
458
9
402
404

416
420
10
412
418
424
430
447
428

FIG. 6
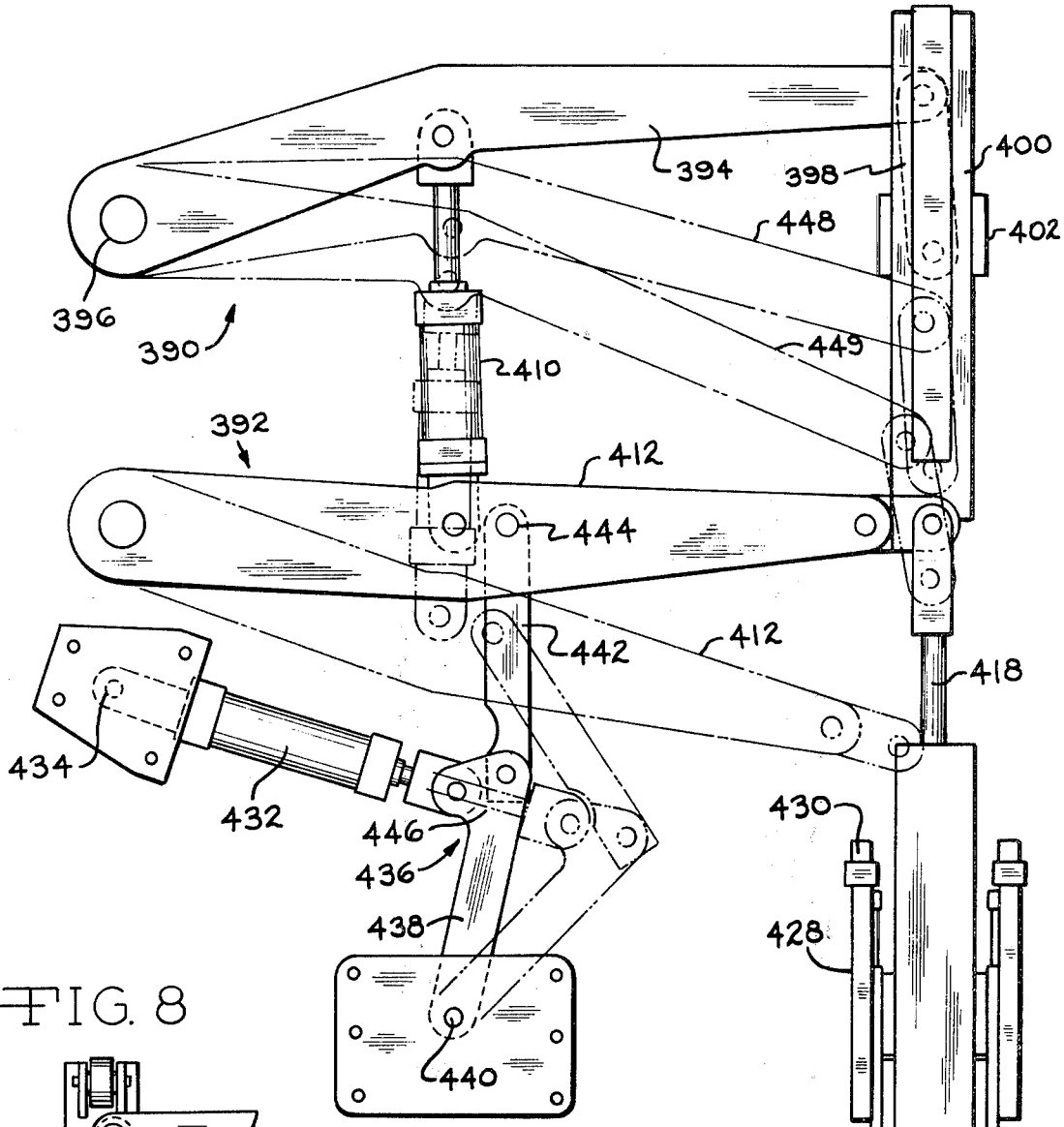
FIG. 8
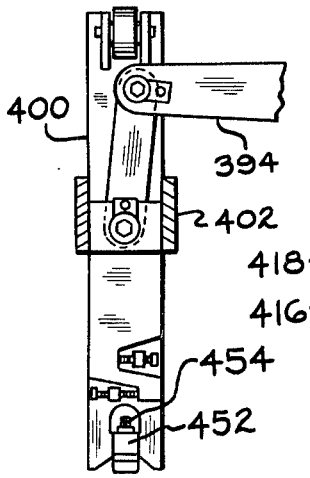
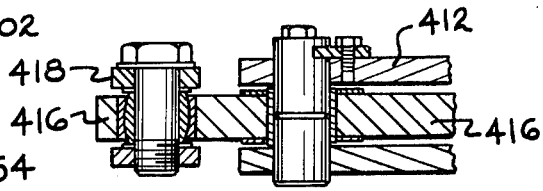
FIG. 10

FIG. 24C
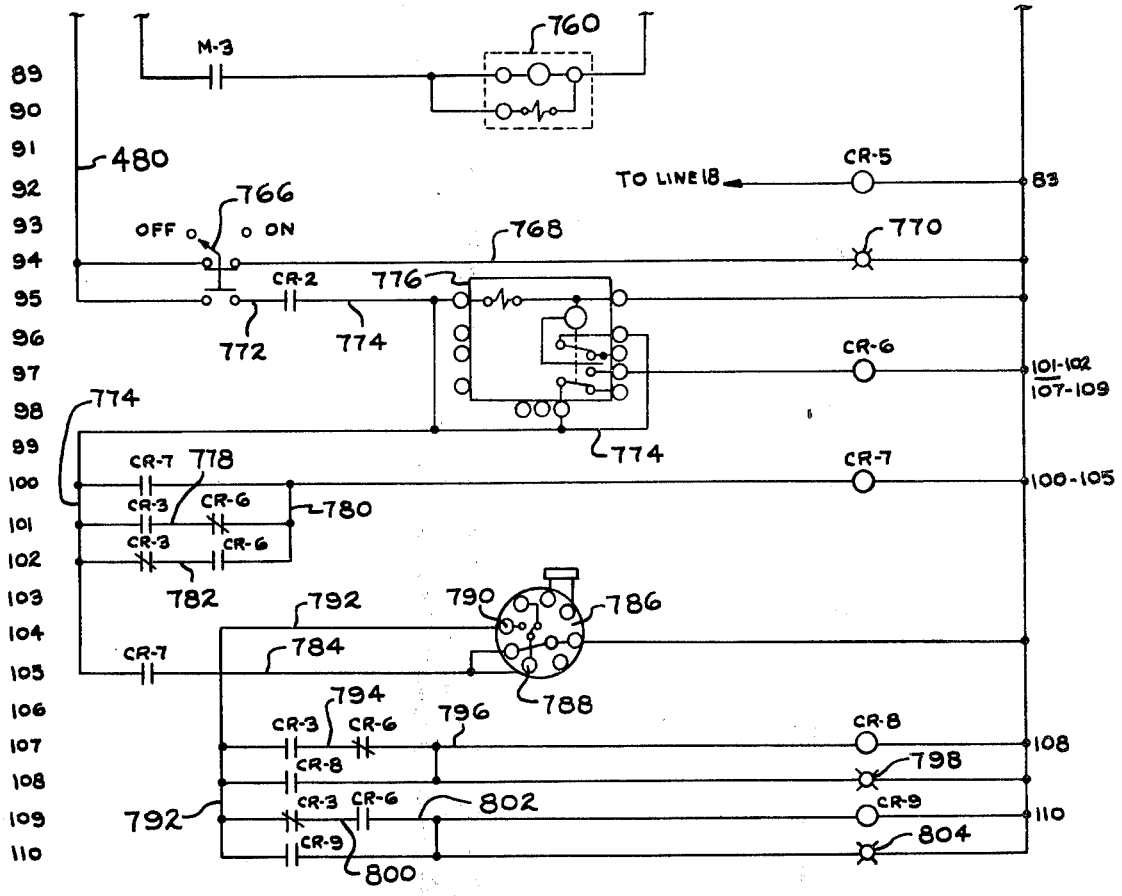
FIG. 18
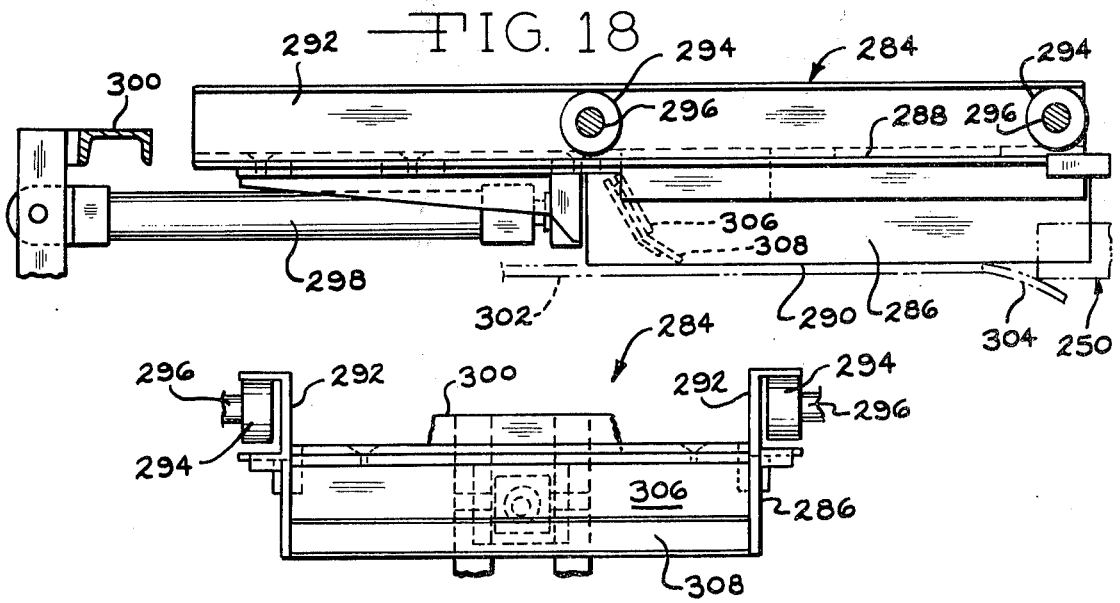
FIG. 19

462
460
A
B
C
464
M-1
M3
M2
M3L
M3R
470
466
266
266
468
478
708
474
472
476
M-1
M-2
1-1-1-10-10
10-11-12
1-1-1
480
PS-1
482
484
LS-10
486
CR-MA
CR-MB
16-18-20-31
38-40-47
42-63-67-76
78-44
490
492
494
498
500
502
504
506
508
510
488
SS-1
SS-2
LS-6
CR-A
17-19
496
512
516
CR-3
518
520
522
TO LINE 92
526
LS-1A
LS-8
LS-7A
LS-8A
514
712
716
710
714
524
TO LINE 41
528
LS-4
CR-4L
CR-41
22-23-24-47
51-67-76
LS-1
CR-1
CR-2
530
CR-2
548
534
532
706
536
OFF
ON
552
LS-2
538
540
542
718
720
544
550
554
558
556
722
724
560
754
682
686
688
690
692
694
LS-7
LS-6
LS-5
684
728
726
696
578
580
582
TO LINE 20
730
584
CR-10L
600
732
734
602

BLOCK MOLDING MACHINE

REFERENCE TO PENDING APPLICATION

This is a division of application Ser. No. 344,137, filed Jan. 27, 1975, now U.S. Pat. No. 3,961,874.

BACKGROUND OF THE INVENTION

The present invention relates to improvements in concrete block molding machines, and particularly to improvements for minimizing sound emissions, reducing safety hazards, and for obtaining optimum performance from the machine.

Among the defects inherent in concrete block forming machines of the type found in the prior art, is their inadequacy to provide protection to the operators and other personnel in the vicinity from excessive noise and other hazards caused by the movable components of the machines. Efforts have been made to overcome these defects by constructing sound insulated enclosures adapted to enclose the existing types of concrete block machines, but these efforts have proved to be unsatisfactory.

The prior block machines are relatively large and have many movable components such as a moldbox arranged to be vibrated, a feed drawer assembly, a compacting and sizing head assembly, a strip mechanism, a pallet hopper and associated pallet feed mechanism, ejector means for removing a pallet loaded with concrete blocks, and the like. Further, these machines are frequently used in a plant as part of a continuous block forming and curing system. Under these circumstances, efforts merely to overcome the inadequacies of the prior art by placing sound insulated enclosures around the machines results in large, unwieldly structures which are inefficient from the space standpoint, interfere with normal operations, are costly, and are undesirable for numerous other obvious reasons.

SUMMARY OF THE INVENTION

The present invention has overcome inadequacies of the prior art and provides an improved concrete block forming machine which is characterized by its compact and efficient size and which provides a sound insulated enclosure that is an integral part of the frame of the machine. The major movable components of the machine are mounted on the frame internally thereof so that sound emissions from these components originate from within the enclosure and are restricted in escaping therefrom to tolerable magnitudes by the insulating properties of the enclosure. The enclosure also functions as a shield to protect personnel from being exposed to bodily harm or other hazards created by these components when the machine is in operation. The various components have been modified or rearranged so as to improve their cooperation, to enhance the compactness of the machine and to cooperate in reducing the original source of sound emissions within the enclosure.

According to one form of the present invention, an improved block molding machine is provided having a plurality of movable components for molding blocks, the components including a moldbox, a feed drawer, a pressure head assembly, a strip mechanism, and an ejector and pallet feed mechanism. The improvement comprises said frame having right and left side rigid frame panels connected in generally parallel relationship and on the inner surfaces of which the components are mounted for support for making their various movements. The frame is substantially closed at the front, top and rear by sound insulation panels so that said frame panels and sound insulation panels cooperate to define a sound insulation enclosure for the movable components and also to provide a shield to protect operators from exposure to the movable components during operation of the block molding machine. Empty pallets are fed into the machine through a slot in one of the rigid frame panels, the slot having a size so that one of the pallets in a series will substantially fill the opening of the slot to minimize transmission of sound through the slot. An inlet chute extends through the top sound insulation panels for feeding aggregate material to the moldbos, the material normally being in the chute during operation of the machine to close the opening of the chute so as to minimize transmission of sound through the opening in the top. Green molded blocks are ejected from the machine through an opening in the front sound insulation panels defined by a sound insulated tunnel which has a cross section substantially corresponding to that of the blocks loaded on a single pallet. Also, a flap gate is located in the tunnel to provide a further obstacle to transmission of sound from the machine through the sound-insulated tunnel. For the purposes of compactness, vibration motors for actuating eccentrics mounted on the moldbox for vibrating the latter are mounted on the external sides of the rigid frame panels and are connected to the eccentrics by means of drive belts which pass through relatively small openings in the sides of the rigid frame panels. Thus, all of the movable components of the block molding machine which contribute to loud emissions of noise are confined within a substantially closed sound insulation enclosure. Furthermore, this enclosure protects the workmen in the vacinity of the machine from hazardous exposure to the moving components.

One of the features of the present invention which contributes to minimizing sound emissions, but which also has separate application for use in other molding machines is the feed drawer assembly. A table plate is provided generally in the plane of the open top of the moldbox and is supported by the frame adjacent to the moldbox, and the chute for receiving the material has its outlet end located over the table plate. The feed drawer assembly for charging the material from the chute into the open top of the moldbox has a feed drawer with an open top and bottom and rails on opposite sides for travel between a first position on the table plate with the open top of the feed drawer in communication with the chute and a second position with the open bottom in communication with the open top of the moldbox. The frame supports a pair of horizontally spaced feed drawer rollers on the inside surface of each rigid frame panel on which the rails are mounted. The feed drawer rollers have rubber or elastomeric treads to provide smooth and relatively quiet travel. A feed drawer cylinder is operatively connected to the frame and to the feed drawer for moving the feed drawer between its first and second positions. Control means are also connected to the feed drawer cylinder for reciprocating the feed drawer in relatively short strokes for a limited time period immediately after it has been moved to its second position over the moldbox. The described arrangement assures smooth and uniform travel of the feed drawer in a relatively noiseless condition. The feed drawer also has improved wiper means for cleaning the top surface of the table plate, and an improved sealing means between the table plate and the moldbox to minimize spilling of the aggregrate material during charging to lower portions of the machine.

Another feature of the present invention which contributes to its relatively quiet operation and which also provides improvements in operation of the described molding machine as well as in other machines is the construction and arrangement for delivering to the moldbox pallets upon which green blocks will be molded. The improved pallet magazine is supported by the frame on the rearward side of the moldbox and has a discharge portion open on the lower front side for releasing the lowermost pallet therein for transfer forward to the moldbox. The pallet magazine also has an inlet portion for receiving pallets fed singly thereinto. An ejector and feed mechanism is mounted on the frame for removing the lowermost pallet from the magazine and transferring it to the moldbox. The pallets are fed singly into the magazine through the slot in the one rigid panel, as was described previously. By virtue of the construction and arrangement of the pallet magazine a uniform but minimum load will be placed on the ejector and pallet feed mechanism when it reciprocates for the purpose of removing a pallet from the magazine and positioning it adjacent to the underside of the moldbox. The magazine is detachably secured to the frame and is relatively light in weight so it can readily be removed through the rear side of the enclosure to provide easy access to the moldbox, when such access is required.

Another feature of the present invention which contributes to improved sound characteristics of the machine and which also can have separate application in other machines is the construction and arrangement of the head assembly and the strip mechanism. The strip mechanism is mounted on the frame for supporting a pallet under the feed box, and the head assembly is mounted on the frame for compressing and sizing the material in the moldbox during vibrational movement of the moldbox. The strip mechanism and head assembly each have actuating means. The actuating means are operably innerconnected for (1) raising said head assembly relative to the strip mechanism an amount sufficient to enable feeding of material into the moldbox by the feed drawer, (2) subsequently holding the head assembly and strip mechanism together as a unit when a block has been sized in the moldbox, and (3) lowering the head assembly and strip mechanism as a unit for stripping a block from the moldbox. The actuating means for the head assembly and for the strip mechanism include respectively the head cylinder connected between the head assembly and the strip mechanism, and a strip cylinder connected respectively between the strip mechanism and the frame. A unique arrangement of a knuckle joint is provided between the strip mechanism and the frame for supporting the moldbox in an elevated position during vibration thereof. When so supported, the pallet under the moldbox is supported by the strip mechanism by rubber or elastomeric supports. The frame also supplies vertically positioned guide rollers for use in conjunction with guides on the head assembly and strip mechanism for properly guiding the head assembly and strip mechanism during vertical movements thereof. These rollers also have rubber of elastomeric treads for optimum guiding characteristics and also to minimize sound emission.

Still another feature of the present invention which contributes to the low noise emission from the block molding machine and which also has separate application in other types of molding machines is the ejector and pallet feed mechanism. As previously indicated, this mechanism is operable to position a pallet under the feed box, and simultaneously therewith it also functions to eject a pallet, on which a green block from a previous cycle of operation has been stripped from the feed box and is positioned therebelow. This loaded pallet is transferred by the ejecting operation to a runout conveyor for discharging the loaded pallet through the insulated tunnel. The pallet feeder and the frame have cooperating guide means so that when the ejector and pallet feed mechanism is moved forward the pallet feeder on which the one pallet, which has been removed from the magazine is now positioned, will be elevated to position the pallet adjacent to the underside of the moldbox. This assures that the pallet is against the moldbox prior to removal of the head from the moldbox after the gripping operation so that a clean contact will be provided between the pallet and the bottom of the moldbox. To a limited extent it also serves to reduce cycle-time. The cooperating guide means include rollers operatively supported on opposite sides of the frame and contoured guide brackets on opposite sides of the pallet feeder for traveling on the rollers. The latter have rubber or elastomeric treads to provide relatively guiet operation during movement of the pallet feeder. Such movement is provided by a double-acting cylinder operably connected between the pallet feeder and the frame.

Various other features such as rubber shock absorbers, safety switches, and the like for minimizing noise from the machine and also to provide safety devices preventing workmen from access to the machine during its normal cycle of operation are also provided.

Thus, it is the object of the present invention to provide an improved block molding machine characterized by its relatively quiet operation and its safety features, and which has improved construction and arrangement of its movable components which embody features contributing to quieter operation of the machine and which also have separate application in other block molding machines.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 6 is a side elevational view of the head assembly and strip mechanism showing in broken lines various positions of movement of the head assembly and strip mechanism;

FIG. 8 is a fragmentary section taken on the lines 8—8 of FIG. 5;

FIG. 10 is an enlarged fragmentary section taken on the lines 10—10 of FIG. 7;

FIG. 18 is a fragmentary side elevational view of the feed drawer assembly as mounted above the table plate adjacent to the feed drawer;

FIG. 19 is a fragmentary rear elevational view of the feed drawer;

DESCRIPTION OF THE PREFERRED EMBODIMENT

Figure 1:
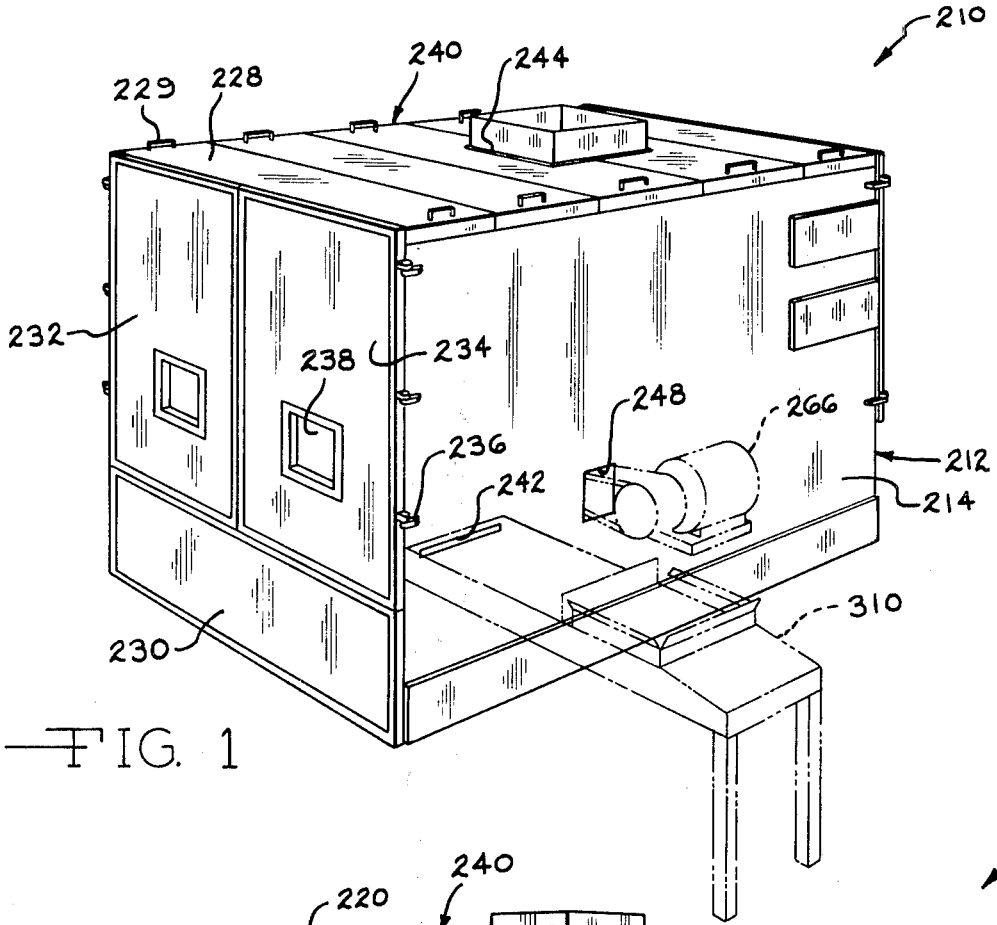
FIG. 1 is a rear perspective view of a block molding machine embodying one form of the invention and showing adjacent to one side in broken lines a schematic arrangement of an auxiliary pallet feeder, and also showing in broken lines one of the vibration motors for vibrating the moldbox.
Figure 2:
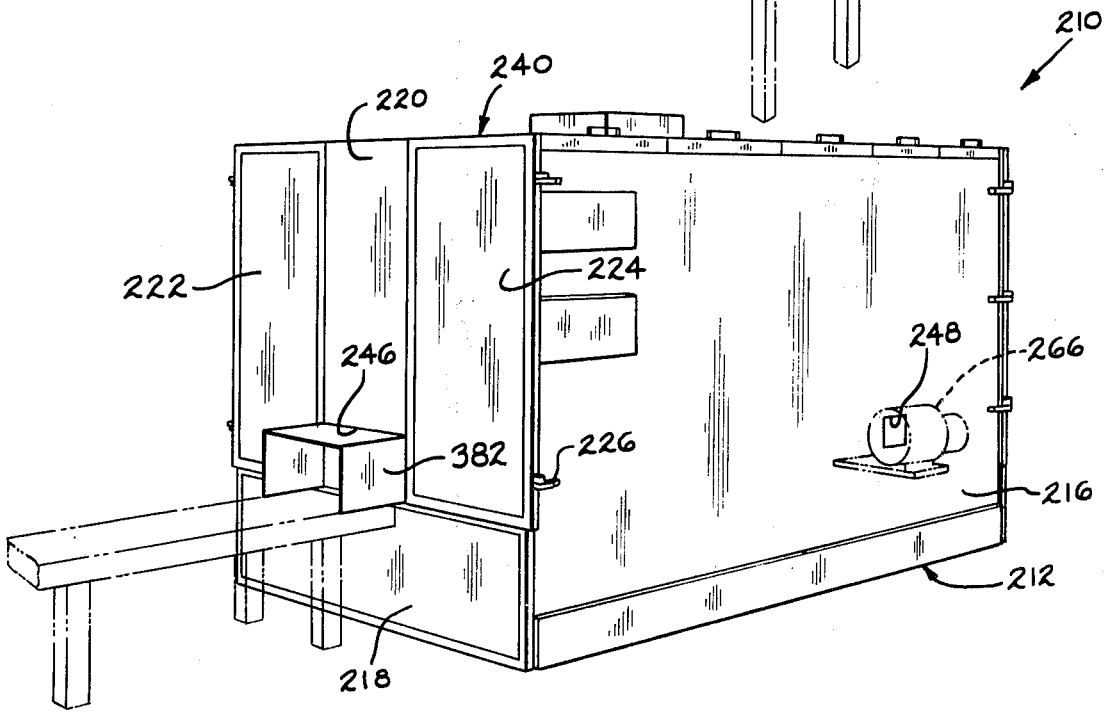
FIG. 2 is a perspective front view showing in broken lines a conveyor for receiving pallets loaded with green molded blocks, and also showing mounted on one side in broken lines the other vibration motor for vibrating the moldbox.
Figure 3:
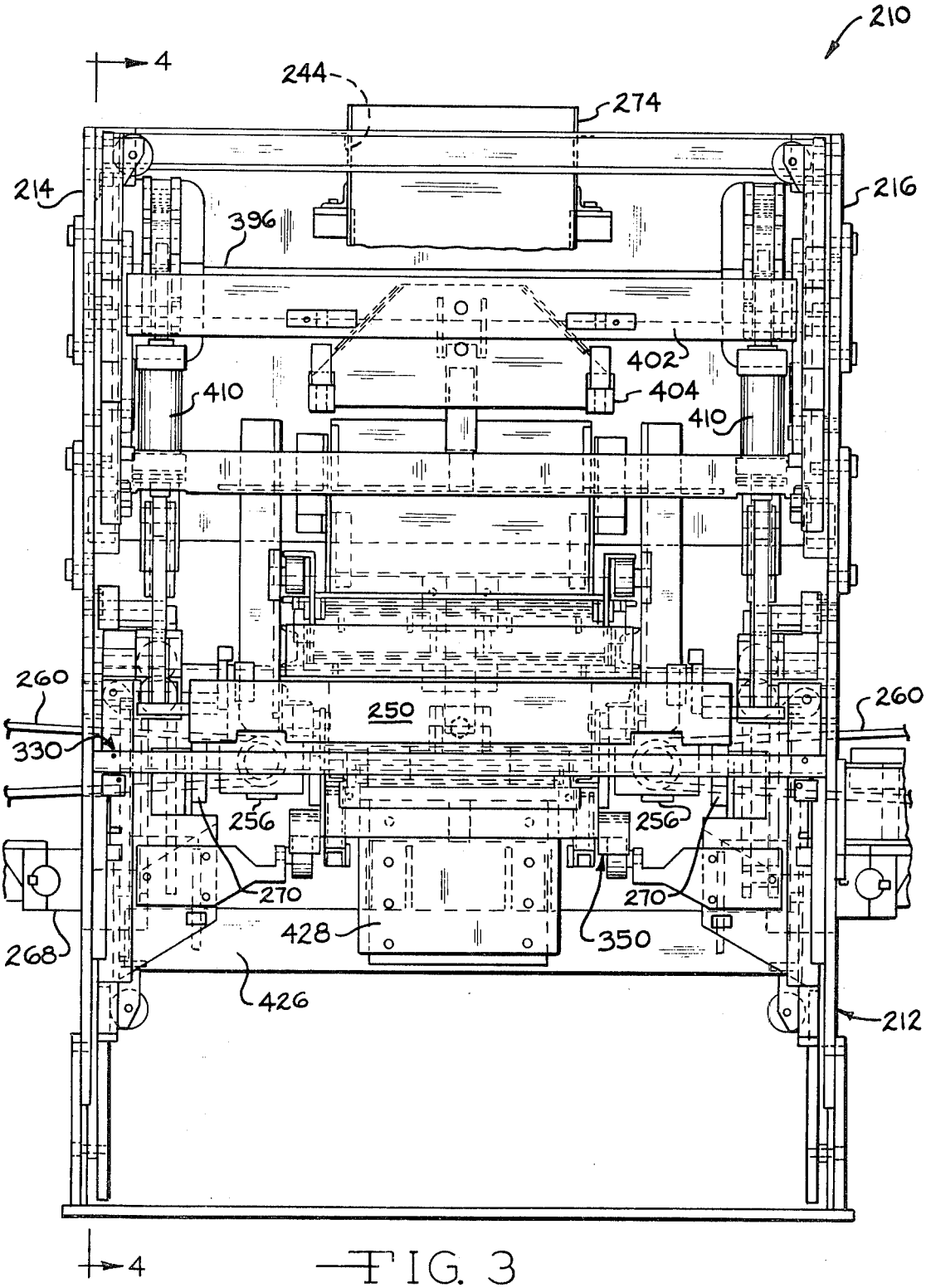
FIG. 3 is a rear elevational view of the molding machine with the rear sound insulation panels removed and with other components shown fragmentarily or eliminated to facilitate illustrating the general arrangement of the block molding machine.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The concrete block molding machine 210 has a frame 212 which includes a right side rigid frame panel 214 and a left side rigid frame panel 216 which are connected together in generally parallel spaced relationship. The front side of the frame is substantially closed by sound insulation panels 218, 220, 222 and 224. Panels 222 and 224 are hingedly connected to the frame by the hinges 226 to permit them to be swung open for gaining access to the interior of the block molding machine from the front side. Panels 218 and 220 are secured in place, but they can readily be removed if removal is required. The top side of the frame is closed by a plurality of manually removable sound insulation panels 228 which have handles 229 at opposite ends to facilitate removal. Similarly, the rear side of the frame 212 is closed by sound installation panels 230, 232 and 234. The latter two panels are hingedly connected to the frame 212 by a plurality of hinges 236 so that these panels can be swung open when desired. The latter two panels also have windows 238 therein to permit visual inspection of the interior of the block molding machine 210 when in operation.

The rigid frame panels 214 and 216 and the sound insulation panels 218, 220, 222, 224, 228, 230, 232 and 234 cooperate to define a sound insulation enclosure 240 which is substantially closed to the environment. During operation of the concrete block molding machine 210 it is necessary to introduce empty pallets to the machine and also to introduce aggregate material for use in molding the green concrete blocks. It is also necessary to have a discharge outlet on which pallets loaded with the green blocks can be ejected. For these purposes a slot 242 is provided in the right side rigid frame panel 214 of a size sufficient to permit passage of a pallet. Similarly, an inlet port 244 is provided in the top insulation panels 228 for receiving aggregate material from an external source. In a like manner, an outlet port 246 is provided in the front insulation panels 218, 220, 222 and 224 through which the block-loaded pallets can be discharged in single file. As will subsequently be described, to provide compactness of the enclosure 240 and the block molding machine 210 and to protect the vibration motors from contamination or the like, they are mounted on the external side of the frame 212. Therefore, small openings 248 are provided in each of the side rigid frame panels 214 and 216 through which belts, to be described, can extend. Thus, a sound insulation enclosure 240 is provided for enclosing all of the major movable components of the block molding machine 210 to minimize sound emission and also to protect operating personnel from exposure to injury by the moving components. Compactness of the machine is achieved because the enclosure is an integral part of the machine and also because of arrangement of the components within the frame.

One of the moving components within the enclosure 240 is the moldbox 250 which will be described with particular reference to FIGS. 1–4, 13 and 14. The moldbox 250 has an open top 252 into which aggregate material can be introduced in a manner subsequently to be described and an open bottom 254 against which a pallet will be held during vibration of the moldbox for forming green concrete blocks. The moldbox 250 is agitated or vibrated by means of a plurality of eccentrics 256 mounted on the shafts 258 which are driven by the belts 260. The belts 260 are drivingly connected between the wheels 262 fixed on the shafts 258 and the wheels 264 outside of the enclosure 240 on the shafts of the electric vibration motors 266. The electric motors 266 are supported by the bracket means 268 to the rigid side panels 214 and 216, and as previously explained, the belts 260 extend through the openings 248 in these panels. The frame 212 has connected to the inner surfaces of the rigid side panels 214 and 216, the moldbox rest members 270 by means of the rigid brackets 272. When the moldbox 250 has been elevated out of contact with the moldbox rest members 270 by the stripper mechanism (to be described), the turning of the eccentrics 256 by the vibration motors 266 will then serve to vibrate the moldbox in a vertical direction in a mannner now conventionally performed in the art.

Figure 4:
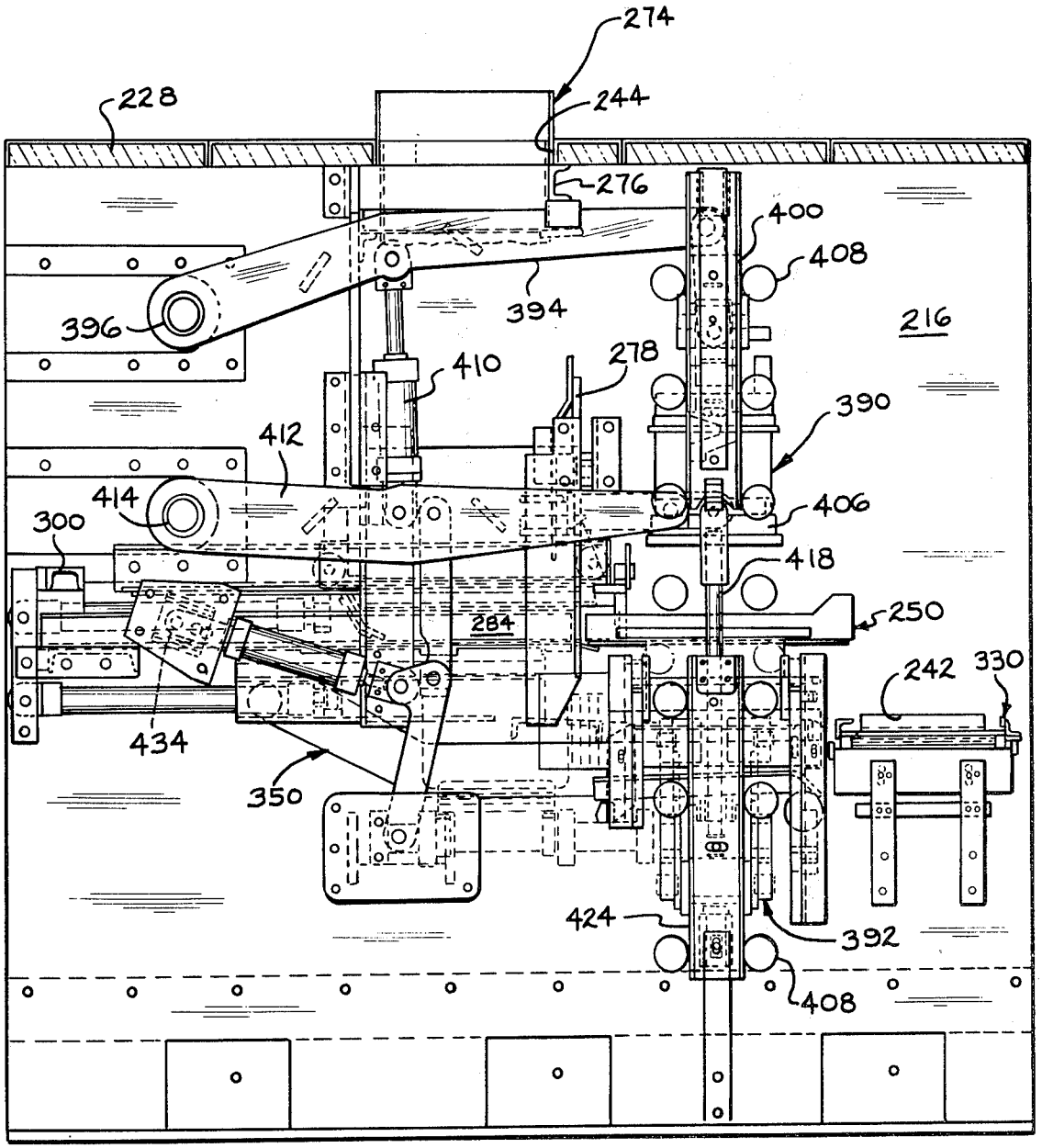
FIG. 4 is a fragmentary sectional view taken on the lines 4—4 of FIG. 3 with various components of the machine omitted to facilitate illustrating the general arrangement of the components.

Extending through the inlet port 244 in the top insulation panels 228 is a chute 274, the upper portion of which is supported on the transverse channel beam 276 extending between the rigid frame panels 214 and 216. Connected to the upper chute portion, only a fragment of which is shown in FIG. 4, is the lower chute portion 278. Specific details of the lower chute portion 278 can be seen best in FIGS. 15, 16 and 17. The lower chute portion is open at the bottom at 280 and has an adjustable plate 282 to aid in regulating the flow of the aggregate material to the feed drawer assembly 284. Details of the feed assembly 284 can be seen best in FIGS. 18 and 19.

The feed drawer assembly 284 includes the feed drawer 286 which is open at the top 288 and at the bottom 290 and has rails 292 on opposite sides for travel on the feed drawer rollers 294 which are supported for rotation on the fixed shafts 296 supported for rotation on the fixed shafts 296 supported by the rigid frame panels 214 and 216. Also connected to the feed drawer 286 is the feed drawer cylinder 298 which is also connected to the rigid frame panels 214 and 216 by the transverse channel member 300. The feed drawer cylinder 298 is operable for moving the feed drawer 286 on the feed drawer rollers 294 between a first position on the table plate 302 (which is rigidly connected with the frame plates 214 and 216) so that the open top 288 in communication with the chute 274, and to a second position with the open bottom 290 in communication with the open top of the moldbox 250. The feed drawer cylinder 298 is double-acting for moving the feed drawer between its first and second positions, and is suitably controlled as will be described hereinafter, so that not only can the feed box be moved between these two positions, but when it is moved to its second position over the moldbox, the feed drawer cylinder can be actuated for a limited time period to reciprocate in rather short strokes for aiding in discharging the aggregate material into the moldbox. As will presently be described, the feed drawer rollers 294 have flexible treads to minimize noise emissions when the feed drawer is moved, and for such rollers are utilized to provide relatively smooth movement of the feed drawer as it is actuated by the feed drawer cylinder 298.

In view of the fact that the moldbox is vibrated during compacting and sizing of the green block that is being formed therein, a rigid connection between the table plate 302 and the moldbox 250 cannot be maintained. To avoid accumulation of aggregate material in the lower regions of the block molding machine 210, an elastomeric lip 304 has been provided as an extension of the table plate 302 and is in engagement with the moldbox 250 as can be seen best in FIG. 18. By virtue of this construction and arrangement, when the feed drawer 286 is moved from the position shown in FIG. 18 to the second or advanced position, leakage of material between the table plate 302 and the moldbox 250 is substantially eliminated. The feed drawer 286 also includes a transverse flexible wiper blade 306 which has a flexible lower lip 308 which is arranged to travel on the top surface of the table plate 302 for wiping the latter when the feed drawer is moved toward the moldbox.

As was previously indicated, pallets on which the green blocks are to be molded are introduced into the block molding machine 210 through a slot 242 which is of a size to permit pallets to be introduced singly to the interior of the enclosure 240. For this purpose any conventional auxiliary pallet feeder may be provided on the exterior side of the enclosure 240, and in the present embodiment of the invention a preferred auxiliary pallet feeder 310 is provided. For a brief description of the auxiliary pallet feeder 310, reference is made to FIGS. 20 and 21. As there shown, the auxiliary pallet feeder 310 includes a pallet hopper 312 for receiving a plurality of pallets, an auxiliary frame 314 supporting the hopper 312 and providing a plurality of horizontally disposed lower conveyor rollers 316 and a plurality of upper conveyor rollers 318 between which pallets can be conveyed intermittently in single file through the slot 242 to the interior of the enclosure 240. The pallets are transmitted from the hopper 312 to the slot 242 by means of the shuttle 320 which is mounted for reciprocal movement on the frame 314. This movement is accomplished by use of the rollers 322 mounted on the shuttle 320 for travel on the shuttle rails 324. Movement is imparted to the shuttle 320 by the double-acting pallet feed cylinder 326 which is connected at one end to the auxiliary frame 314 and at the other end to the shuttle 320. The shuttle 320 has pivotally mounted thereon the dogs 328 which are adapted to engage the lowermost pallet in the hopper 312 when the shuttle is moved from the position shown in FIG. 21 to the right toward the slot 242. This action of the dogs 328 will cause movement of a series of abutting pallets, and at the end of the stroke the shuttle will be returned for repeating its operation for feeding another pallet of the series through the slot 242 in timed relation with the operation of the movable components of the block molding machine 210 that are within the enclosure 240.

Figure 20:
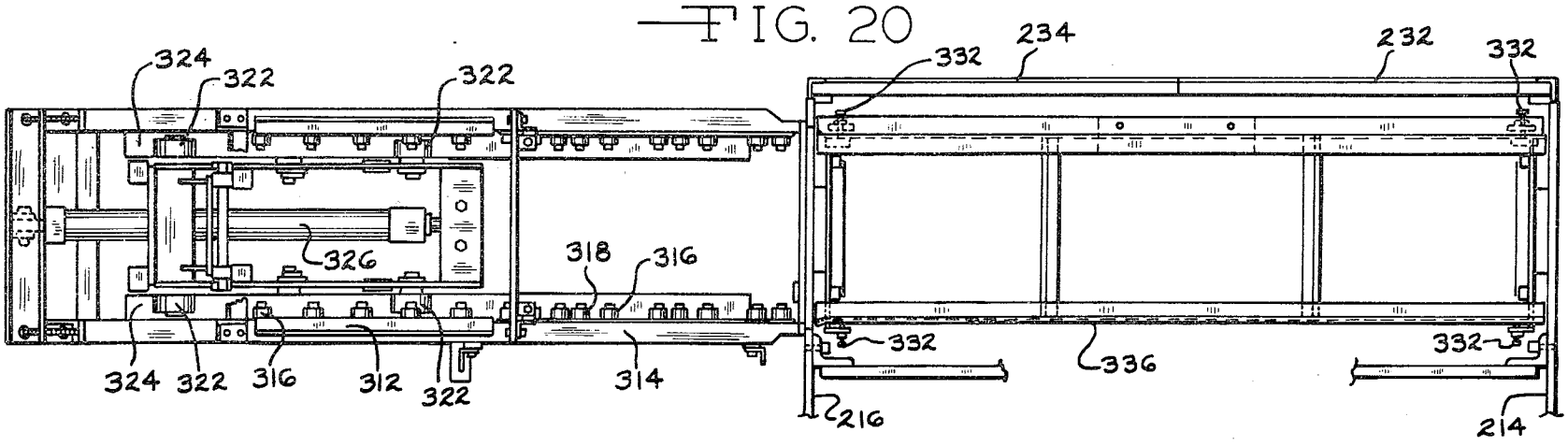
FIG. 20 is a fragmentary top plan view of the pallet magazine located within the rear of the enclosure, and illustrating an auxiliary pallet feeder located exterior of the enclosure for feeding pallets singly into the machine.
Figure 21:
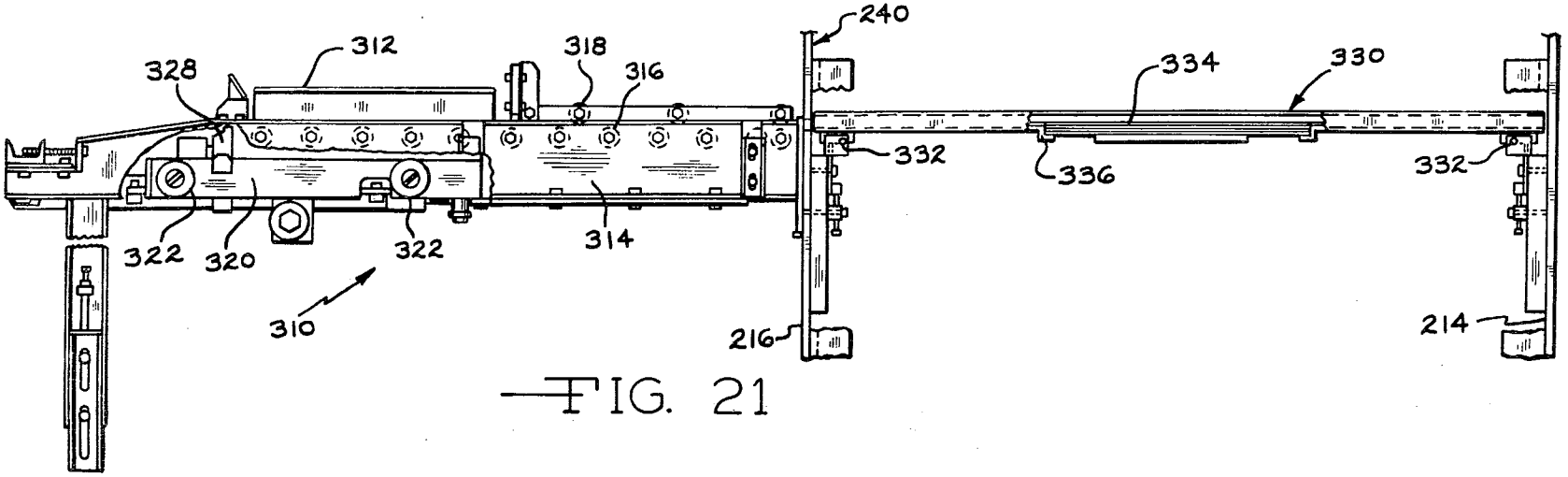
FIG. 21 is a front elevational view of the magazine and the associated auxiliary pallet feeder.
Figure 22:
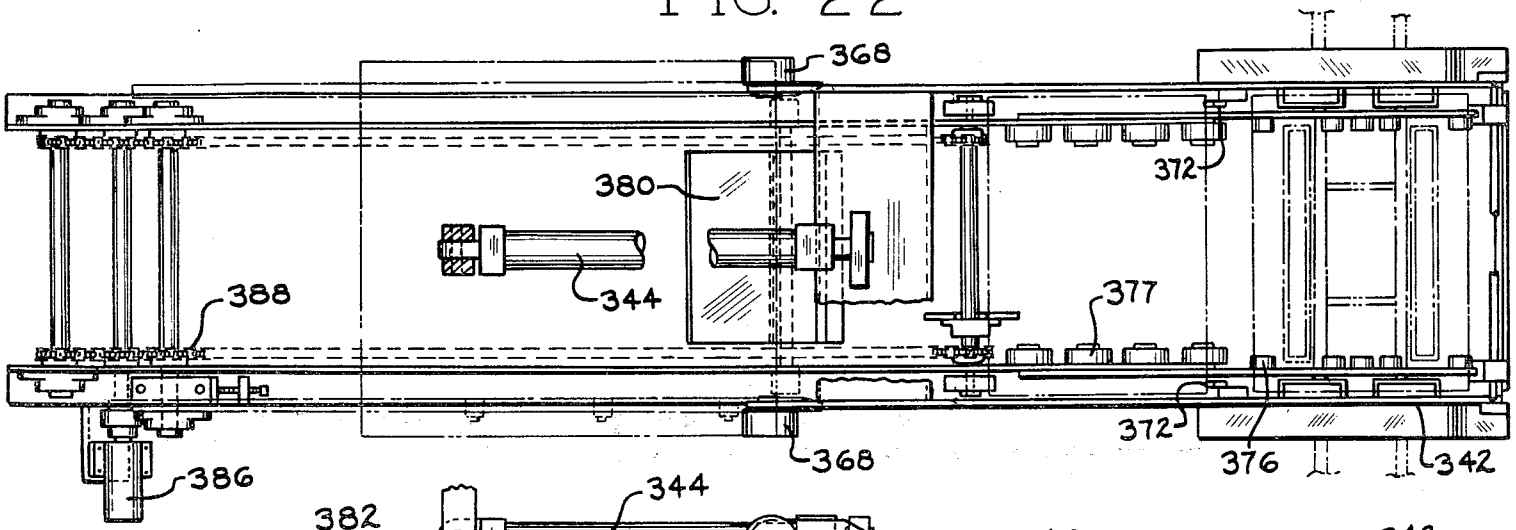
FIG. 22 is a fragmentary top plan view of the ejector and pallet feed mechanism and illustrating the associated runout conveyor over which an insulated tunnel is mounted.
Figure 23:
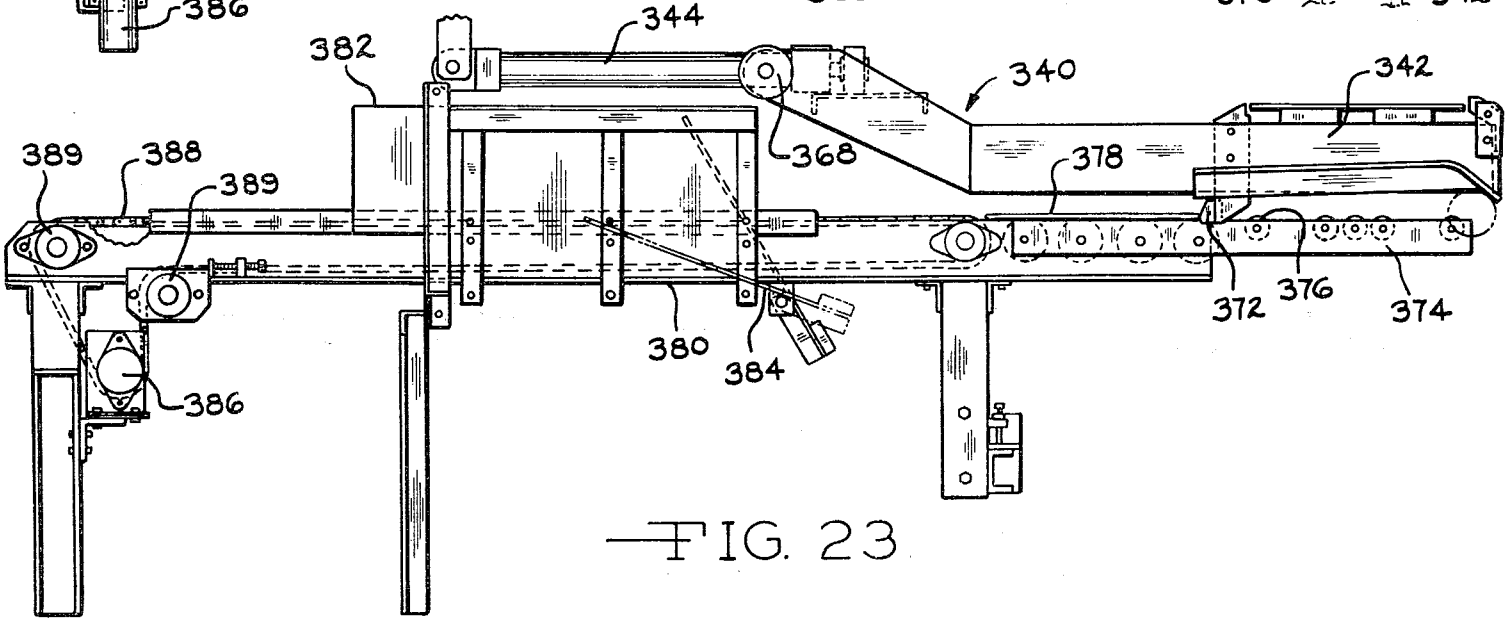
FIG. 23 is a side elevational view of the ejector and pallet feed mechanism and the associated runout conveyor.

The pallets that are fed into the enclosure 240 by the auxiliary pallet feeder 310 are initially received by the removable pallet magazine 330. The pallet magazine 330 is preferably made from a plurality of angle irons such as are shown in FIGS. 20 and 21 which extend transversely between the rigid frame panels 214 and 216 for support thereon and are adjustably secured in place by a plurality of set screws 332 which can readily be released to permit removal of the pallet magazine 330 to provide access to the moldbox which is located immediately forward of the magazine 330. When the pallets are fed into the magazine 330 through the slot 242, they advance singly until they reach the midportion of the magazine 330 wherein they will be deposited in a stacked relationship as shown at 334 where a discharge portion is provided on its front side for release of a pallet for transfer to the moldbox as will subsequently be described. The discharge portion is identified by the reference number 336. Normally the pallets in the stack cannot exceed three in number so that the load applied to the pallet feeder when transferring pallets to the moldbox will be uniform and minimal.

An ejector and pallet feed mechanism 340 is provided for transferring pallets singly in a forward direction from the magazine 330 to a position below the moldbox 250. For a description of the ejector and pallet feed mechanism 340 for transferring a pallet from the magazine 330 to the moldbox 250 and for simultaneously ejecting a loaded pallet from beneath the moldbox 250 and advancing it in the direction of the outlet opening 246 in the enclosure 240, attention is directed particularly to FIGS. 11, 12, 22 and 23.

The ejector and pallet feed mechanism 340 includes a pallet feeder 342 to which is operably connected the ejector and pallet feed cylinder 344. The forward end of the cylinder 344 is connected to a member 346 that is supported by the rigid frame panels 214 and 216, and the other end of the cylinder 344 is connected to the transverse channel member 348 which is connected to a pair of parallel ejector and feed arms 350. The pallet feeder 342 is an integral part of the arms 350 and has mounted on opposite sides guide means or brackets 352 which are adapted to travel on the rollers 354 that are operably mounted in fixed locations on the rigid frame panels 214 and 216. The cylinder 344 is operable to move the pallet feeder 342 between a forward position shown in solid lines and a rearward shown in broken lines in FIG. 11. When the pallet feeder 342 is in the forward position it will be in an elevated position immediately below the moldbox 250 as a result of the contoured guide surfaces of the guide brackets 352 which rest on rollers 354. When the pallet feeder 342 is in the rearward position it will be under the magazine 330, and the dogs 356, which are pivotally mounted on the transverse rod 358 between the parallel arms 350, will be in engagement with a lowermost pallet in the magazine 330 such as is indicated at reference number 360. When the pallet feeder 342 has been moved to its forward position the pallet shown at 362 will have been elevated and will be substantially in engagement with the lower side of the moldbox 250. During this movement the pallet will be supported on the pallet support blocks 364 and can subsequently be lifted from these blocks by the stripper mechanism, to be described, for elevating of the moldbox for subsequent vibrating action.

Figures 11, 12, 13, 14, 15, 16, 17:
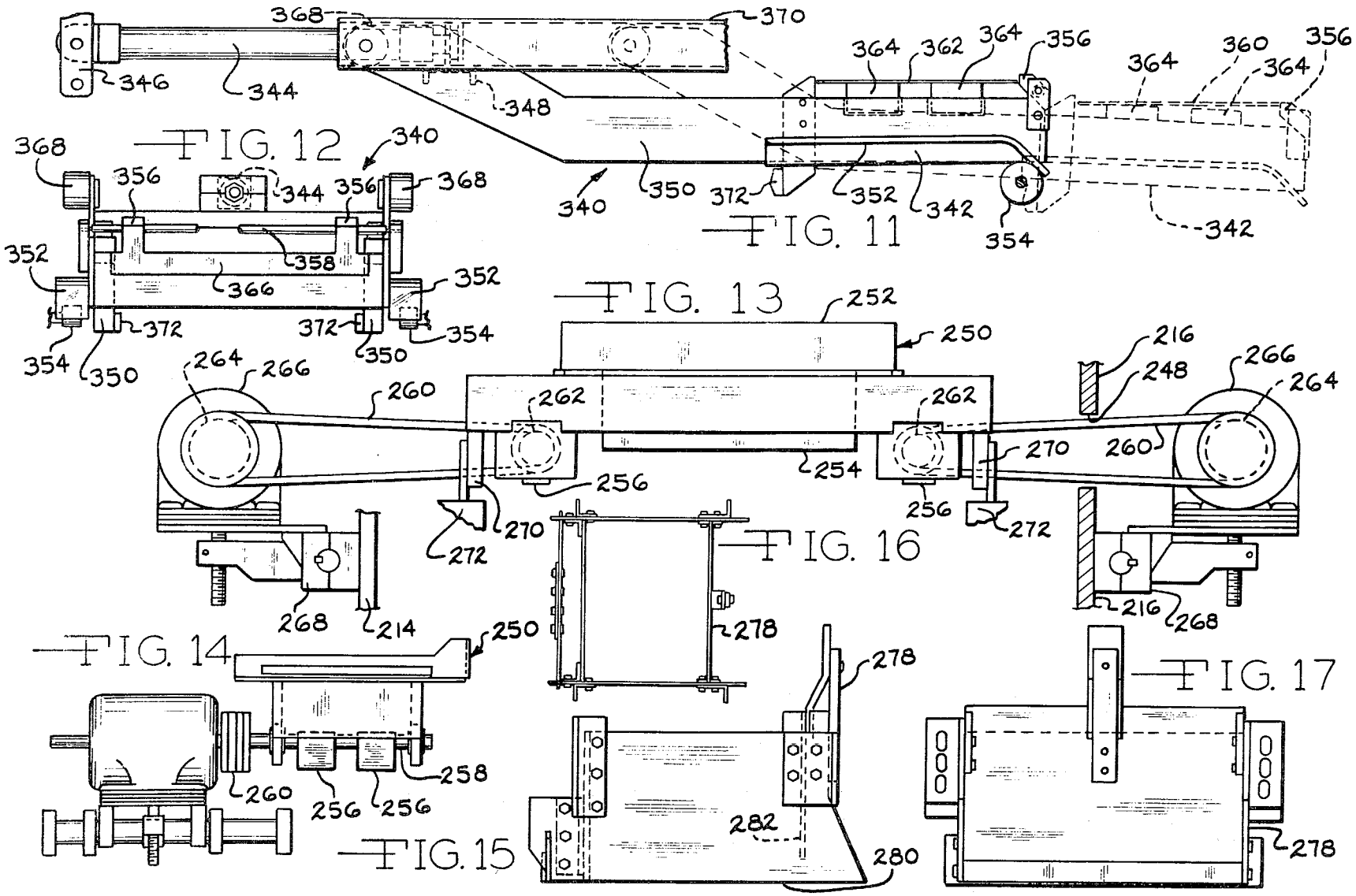
FIG. 11 is a fragmentary side elevational view of the ejector and pallet feed mechanism showing the pallet feeder in its forward position in solid lines and in its rearward position in broken lines.
FIG. 12 is a rear elevational view of the ejector and pallet feed mechanism.
FIG. 13 is a fragmentary rear elevational view illustrating the vibration motors and the moldbox.
FIG. 14 is a fragmentary side elevational view of one of the vibration motors and the moldbox.
FIGS. 15, 16 and 17 are respectively fragmentary side elevational, top plan and rear elevational views of a portion of the feed chute.

As can be seen best in FIG. 12, the dogs 356 are integrally connected to the transverse weighted plate 366 to allow the dogs to be pivoted during rearward movement out of the plane of the lowest pallet in the pallet magazine 330 and thereafter to be pivoted upward by the action of the plate 366 to an upright position for engaging the rear edge of the lowermost pallet. For guidance of the forward ends of the arms 350 rollers 368 are provided on the external sides of the arms 350 and are adapted to travel in rails 370 supported on the rigid frame panels 214 and 216.

Also forming an integral part of the pallet feeder 342 are the pair of spaced ejector elements 372 which are located so that when the pallet feeder 342 is advanced from its rearward to its forward position, the ejector elements will engage a loaded pallet positioned below the moldbox 250 by the stripping action of the previous cycle of operation. The stripping action will subsequently be described, but when this action has occurred the block loaded pallet will be deposited on the conveyor 374 for movement on the rollers 376 and 377 in a forward direction. When the block-loaded pallet is moved forward it will occupy the position of a previously transferred block-loaded pallet at 378 which in turn has been advanced onto the runout conveyor 380 for discharge through the tunnel 382 that extends through the discharge outlet 246. The tunnel 382 is constructed of sound insulation panel material to minimize transmission of sounds from within the interior of the enclosure 240 to the exterior. To further reduce transmission of sounds through the tunnel, a flap gate 384 is pivotally mounted on the runout conveyor 380 and has a weighted end portion for normally pivoting the flap gate to the closed position as shown in solid lines. By virtue of the pivotal mounting of the flap gate a block-loaded pallet can engage and pivot the flap gate to the broken line position to allow passage of the loaded pallet, after which the flap gate will automatically return to the closed position. By virtue of this construction and arrangement sound transmission is further restricted from escaping through the tunnel 382.

The runout conveyor 380 includes a motor 386 which is adapted to drive the belt 388 over the series of wheels 389 for transmitting a loaded pallet through the tunnel 382 to the exterior of the enclosure 240 for further disposition.

Attention is next directed to FIGS. 3-10, inclusive, for a description of the head assembly 390 and the strip mechanism 392 which cooperate in compacting and sizing a green block in the moldbox 250 and in subsequently stripping the green block from the moldbox. The head assembly 390 includes the pair of parallel spaced head arms 394 which are pivotally mounted on head shaft 396 to the rigid frame panels 214 and 216. The free end of each head arm 394 has pivotally connected thereto a head link 398 which in turn is pivotally connected to the head guide 400. The head guides 400 which are located adjacent to the opposite rigid frame panels 214 and 216 are connected together for uniform vertical movement by a head bar 402. The head shaft 396 on which the head arms 394 are mounted for pivotal movement also extends transversely between the rigid frame panels 214 and 216 as can be seen best in FIG. 3. Secured to the head bar 402 is the head mounting support 404 on which is mounted the head 406 (shown only in FIG. 4). The guides 400 are each located adjacent to the rigid frame panels 214 and 216 on which are located a plurality of parallel head and strip guide rollers 408 between which the head guide is restricted to vertical movement only. Thus, pivotally moving the free end of each head arm 394 will operate to raise and lower the head 390 in a vertical path. Raising and lowering of the head arms 394 is caused by the head cylinders 410 which are operatively connected at their upper ends to the head arms 394 and at their lower ends to the strip arms 412.

The strip mechanism 392 includes the parallel strip arms 412 which are mounted on the strip shaft 414 for pivotal movement. The strip shaft 414 is supported at its opposite ends on the rigid frame panels 214 and 216. The free ends of the strip arms 412 have mounted thereon a strip shock absorber arm 416, and each of the latter is connected at its outer end to the associated strip rod 418. As can be best seen in FIG. 7, the strip shock absorber arm 416 has rubber support blocks 420 between its inner end and the strip arm 412 to provide shock absorber means. Each strip lifting rod 418 is connected at its lower end by means of the bearing block 421 and the rigid bracket 422 to the strip guide 424 and the strip bar 426. The strip bar 426 is connected to both strip arms 412 and extends transversely between them. Mounted midway between the ends of the strip bar 426 is the pallet lifting plate or member 428 which has at its upper end the rubber or elastomeric support blocks 430 for supporting a pallet positioned under the moldbox 250. Thus, when a pallet has been positioned under the moldbox 250 by the ejector and pallet feed assembly 340, raising of the strip bar 426 by elevating the strip arms 412 will result in the pallet being engaged by the rubber support blocks 430 to hold the pallet tightly against the underside of the moldbox 250, and further elevation of the strip bar 426 and associated pallet lifting member 428 will result in the moldbox 250 being lifted off of the stationary rest members 270. The moldbox can then be vertically vibrated with the moldbox being supported only at the rubber support blocks 430.

The strip mechanism 392 also includes the strip cylinders 432 which are connected at one end respectively to the associated rigid panels 214 and 216 as is indicated at 434, and the other end of the strip cylinders 432 are connected respectively to the strip arms 412 by means of a knuckle joint or linkage 436. The latter includes a lower link 438 connected at one end to the associated rigid frame plate as at 440 and at the other end to an upper link 442 that is connected at its upper end, as at 444, to the strip arm 412 and at its lower end to the lower link 438. The upper and lower links 442 and 438 form at their connection a knuckle 446 to which the one end of the associated strip cylinder 432 is pivotally connected. Referring to FIG. 6, it wll be readily apparent that when the strip cylinder 432 is retracted, the knuckle joint 436 will be extended so as to lift the strip arm 412 to its elevated position shown in solid lines, and when the strip cylinder 432 is extended, the knuckle joint 436 will be bent to lower the strip arm 412 to the lower position shown in broken lines. Thus, when it is desired to raise the pallet lifting plate or member 428, such action can readily be accomplished merely by retracting the pair of strip cylinders 432, and when it is desired to lower the pallet lifting member 428, this can be accomplished merely by extending the strip cylinders 432. It will be noted in FIG. 5 that the pallet lifting member 428 may include brackets 447 for aiding in locating the pallet on the rubber support blocks 430 when the strip bar 426 is initially elevated under the pallet.

Referring again to FIG. 6, the head arm 394 can be lowered by gravity to a first lowered position, shown in broken lines at 448, by releasing the pressure in head cylinder 410 to allow head 406 to fall on the material in the moldbox 250, and subsequently the head arm 394 can be lowered to a second position, shown in broken lines at 449, by actuating head cylinder 410 to lock the head arm 394 again to the strip arm 412 and then actuating strip cylinder 432 to bend knuckle joint 436, causing the arms 394 and 412 to move as a unit for stripping the green block from the moldbox 250.

Figures 5, 7, 9:
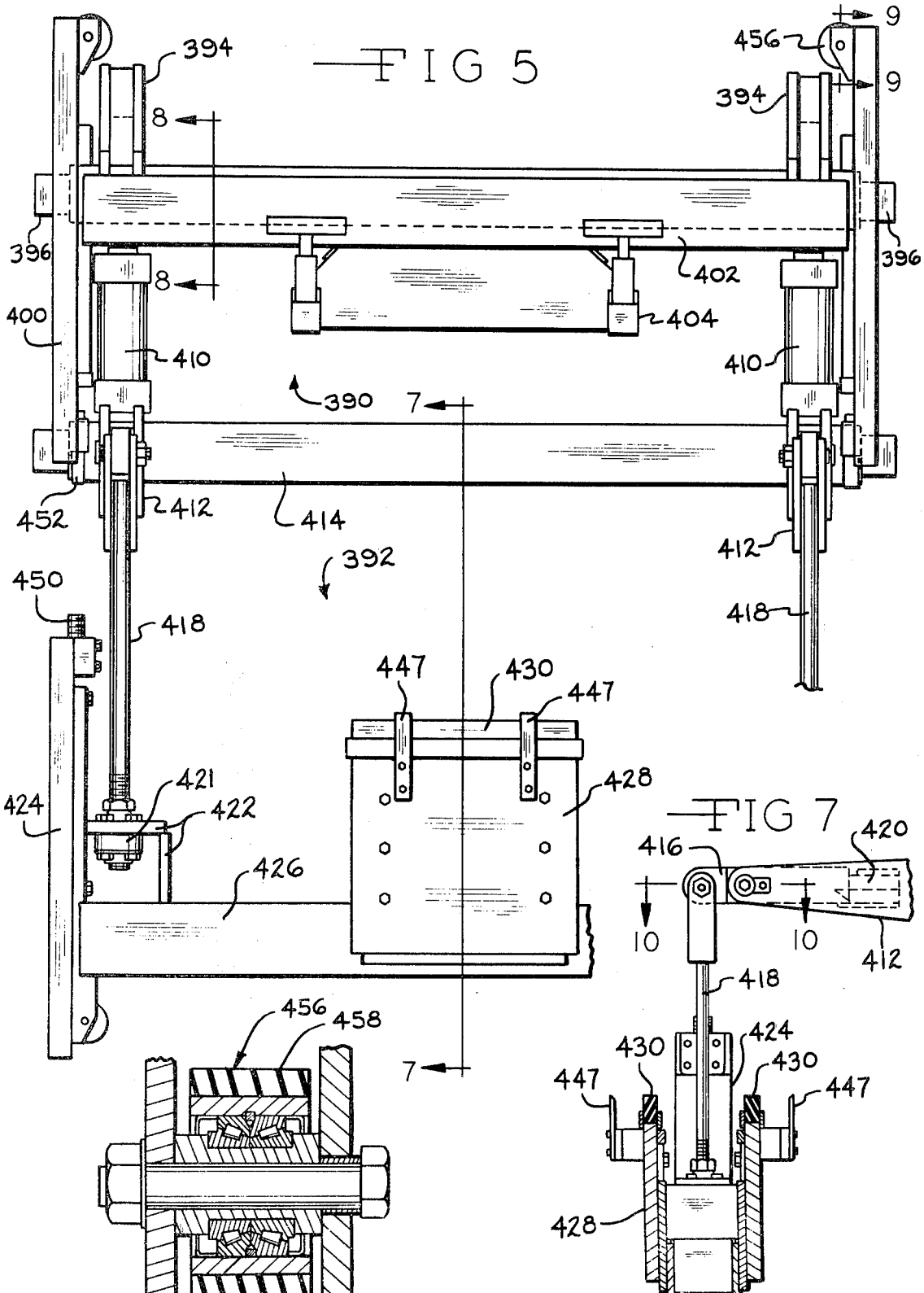
FIG. 5 is a fragmentary rear elevational view of the head assembly and strip mechanism.
FIG. 7 is a fragmentary section taken on the lines 7—7 of FIG. 5.
FIG. 9 is an enlarged fragmentary section taken on the lines 9—9 of FIG. 5.

The strip guides 424 are also mounted for vertical movement adjacent to the rigid frame panels 214 and 216. As can be seen best in FIG. 4, the strip guides 424 are in alignment with the head guides 400 and are adapted to travel between the pairs of head and strip rollers 408 but at a lower level. Also, as shown in FIG. 5, the strip guides 424 have extending upwardly therefrom lower sizing rods or elements 450, and the head guides 400 have upper sizing rods or elements 452 which are adapted to come into engagement during the vibration operation when the green molded block in the moldbox 250 has been properly sized. The upper sizing rods or elements 452 have terminals 454, FIG. 8, which are part of the electrical circuit for controlling operation of the concrete block molding machine 210. The control circuits will subsequently be described.

Attention is directed to FIG. 9 which illustrates the construction of one of the rollers that are utilized throughout the block molding machine 210. It will be observed that the roller 456 illustrated in FIG. 9 includes a flexible rubber or elastomeric tread 458 so as to provide optimum low-sound characteristics within the machine and also to provide ease of movement between the various parts.

Before describing the control circuitry shown in FIG. 24, the general operation of the block molding machine 210 will be described briefly. The description of the operational sequence will start at an imaginary starting point of the machine 210 in which the strip bar 426 is down, the ejector and pallet feed mechanism 340 is in its forward position, the head assembly 390 and head 406 are up, the feed drawer 286 is in its first or forward position, and the auxiliary pallet feeder 310 is retracted. The strip mechanism 392 is started in its "up" motion. When the strip mechanism 392 arrives at the up position, lifting a pallet and raising the moldbox 250 from the frame rests 270, the feed drawer 286 begins to move rearward to its second position over the moldbox 250. As the feed drawer 286 moves rearward, a feed drawer time-delay is started. The feed drawer 286 travels all the way to the rear of its stroke over the moldbox 250, and then the feed drawer cylinder 298 will be repeatedly actuated so that the feed drawer 286 will travel back and forward causing an oscillation motion over the moldbox 150, which will continue until the end of the feed drawer time-delay. At the end of a feed drawer time-delay, the feed drawer 286 returns to the first or forward position. Further, at the instant the feed drawer 286 began advancing to the rear, three major motions took place simultaneously; (1) the feed drawer moved rearward, (2) the ejector and pallet feed mechanism 340 moved rearward, and (3) the auxiliary pallet feeder 310 moved forward and then retracted thereby advancing a pallet into magazine 330. At the end of the feed drawer time-delay, the feed drawer 286 is returned to the forward position in communication with chute 274. When the drawer 286 reached the forward end of its stroke, the head 406 was allowed to move down onto the top of the moldbox 250 so as to cause the head 406 to fall on top of the material for the sizing motion with no pressure being exerted by head cylinder 410. This position of the head 406 corresponds to the first lower position of head arms shown at 448. The head 406 is now down and vibrating of the moldbox 250 occurs at no pressure by head cylinder 410, the sizing motion is now taking place, and material is being vibrated to size. At the option of the operator, a variable pressure can be exerted selectively by the head cylinder 410 for sizing the block under pressure. At the point of sizing, the left and/or right sizing rods 450, 452 come together. A strip delay timer is turned on in response to contact by sizing rods 450, 452. The strip delay timer is used to produce a short time-delay allowing any error in the sizing rods caused by vibration to be corrected before the strip motion takes place. It also allows the flexible block members 430 on the pallet lift member 428 to return to their regular shapes following any distortion that may have occurred during vibration. At the end of strip delay time, the heat 406 is caused to show full hydraulic pressure down by actuation of heat cylinder 410, thus locking the head assembly 390 and the strip mechanism 392 together as a unit. The strip mechanism 392 and the head assembly 390 now move down as a unit in the stripping motion removing the green block from the moldbox 250. The strip member 428 travels down until the head 406 reaches a level where the bottom of the head 406 just clears the bottom of the moldbox 250 corresponding to the lowermost position on 449 of the head arm 394, at which point the head 406 travels up until it reaches the full extent of its up travel. The strip delay timer is then turned off and mechanism 392 started down. The vibrator motors 266 were turned off and the vibration of the moldbox 250 was stopped when the strip mechanism 392 started down. Vibration brakes associated with the vibration motors 266 also were turned on. The strip mechanism 392 continues its travel down until it reaches the bottom of the strok depositiong the loaded pallent on the conveyor 374, and if there is room on the runout conveyor 380 for the next pallet ejected by the ejector and pallet feed mechanism 340, the latter is started forward ejecting the last loaded pallet from below the moldbox 250 and advancing an empty pallet from the magazine 330. This is the start of the next cycle.

Figure 24A:
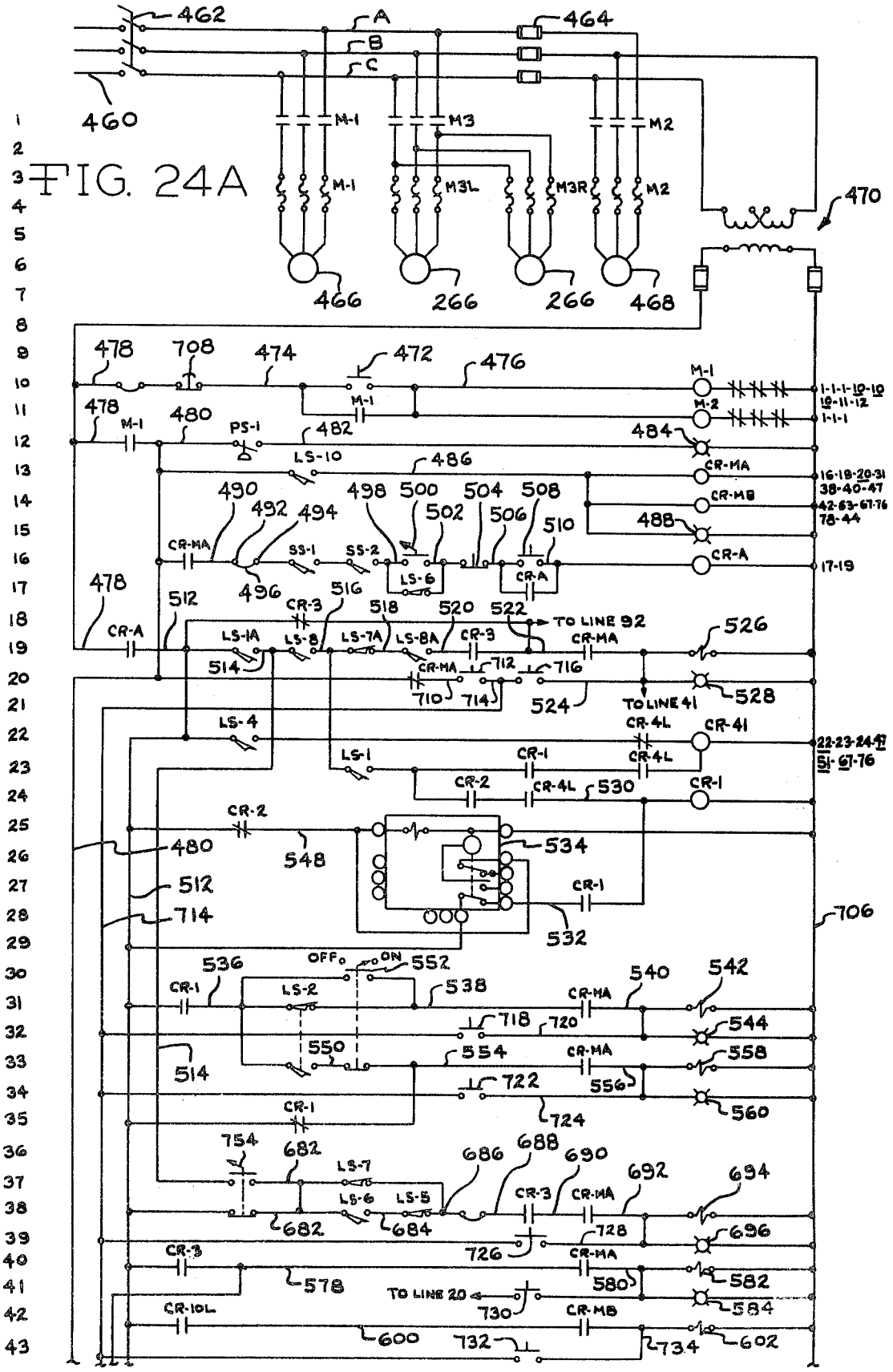
FIGS. 24A, B and C are schematic wiring diagrams of the control circuit for operating the block molding machine.
Figure 24B:
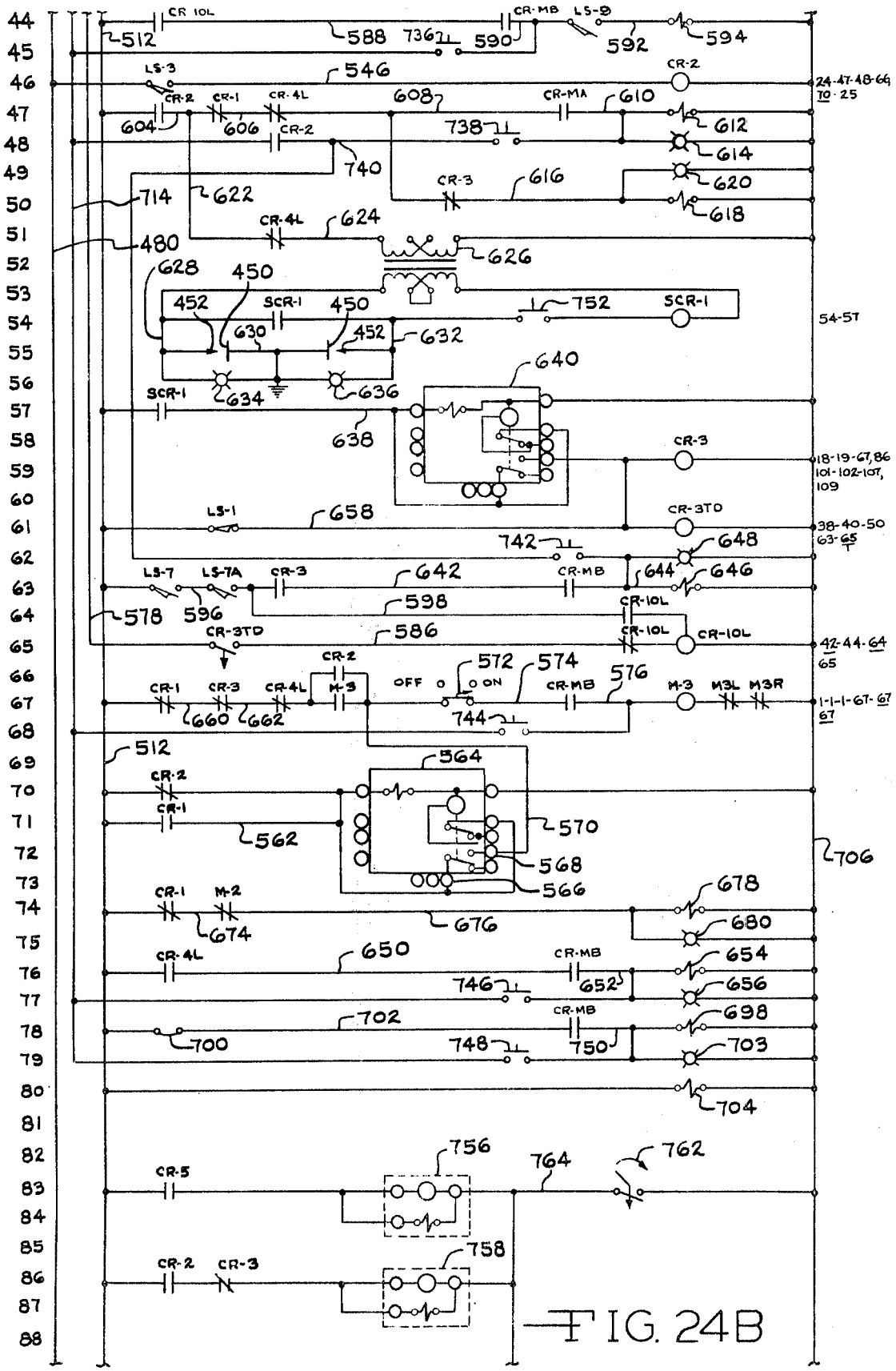

Referring next to FIGS. 24A, B and C, the controls for operation of the block molding machine 210 will be described. The various control elements, such as limit switches and the like, have been omitted from the figures of the drawings previously described for reasons of clarity, but it is to be understood that they are suitably located in the machine in conventional locations for carrying out their intended functions. The following is a description if the operational sequence and in the description, any reference to line numbers will refer to the numbered column down the lefthand side of the ladder diagram and the numbers are to be used to form a grid to follow across the figure to find specific items mentioned. Numbers in the right column indicate other lines affected by components in that line. The beginning of the lefthand column of FIG. 24A, in upper lefthand corner is shown the three phase power line 460 coming into a disconnect switch 462 mounted in the control panel (not shown). From the disconnect 462, phase A, B and C of the three phase power runs to three fuses 464. From those fuses 464 it runs to M-1 motor starter controlling the hydraulic pump motor 466, M-3 motor starter controlling the left and the right vibrator motors 266, and M-2 motor starter — which is an optional motor starter to run an optional fan motor 468 mounted inside the machine frame 212. From phases B and C. a single phase high voltage line runs to the control transformer 470. The control transformer 470 takes either 230 or 460 volts and transforms it into 115 volts for the control power for the remainder of the circuit.

The description of the operational sequence will start, as before, at the starting point of the machine 210 in which the strip bar 426 is down, the ejector and pallet feed mechanism 340 is forward, the head 406 is up, the feed drawer 314 is forward, and the auxiliary pallet feeder 310 is back. Pressing the pump start pushbutton 472 in line 10 will close the circuit between conductors 474 and 476 and turn on the pump motor starter M-1. M-1 will close its own contact in line 11 between conductors 474 and 476 and become self-holding so that the pump start pushbutton 472 may be released and the pump motor starter will remain energized. Also, on line 11 is the fan motor starter M-2, which will not be running along with M-1 if it is used. M-1 also closes the contact in line 12 between conductors 478 and 480. Conductor 480 supplies power to the filter pressure switch PS-1 on the hydraulic pump driven by motor 466. If the filter becomes clogged, pressure will build up in the filter, close PS-1 between conductors 480 and 482 and turn on the pilot light 484 indicating that the filter needs cleaning.

Conductor 480 supplies power also to the pushbutton hang-up limit switch LS-10. If the manually operated pushbutton station is hung in its pocket properly inside the enclosure 240, LS-10 will be held closed in line 13 and power will be supplied between conductors 480 and 486 and conductor 486 will turn on CRMA and CRMB relays and the autoready pilot light 488 on the front of the control cabinet (not shown). CRMA and CRMB relays are two separate relays wired in parallel simply because not enough contacts are available on one relay so two are used. CRMA and CRMB closed contacts throughout the circuit to turn on the automatic portion of the automatic cycle. If the pushbutton station is removed from its pocket, CRMA and CRMB will be turned off and the machine automatically will be in manual mode. CRMA contact closes in line 16 to furnish power between conductors 480 and 490, conductor 490 then feeding power to terminal 492 on the terminal block and between terminal 492 and 494 is shown a jumper 496.

Jumper 496 is for the convenience of the operator. In the event additional cycle "stop" buttons are needed in the plant, the jumper 496 may be removed and a cycle stop button may be connected between terminals 492 and 494. When the front sound insulation panels 222, 224 are closed, the front safety switch FSS-1 is closed. When the rear sound insulation panels 232, 234 are closed, back safety limit switch FSS-2 is closed and power is now furnished to conductor 498. With the normal cycle selector switch 500 turned on, the power is furnished between conductors 498 and 502, and power is passed through normally closed cycle stop pushbutton 504 to conductor 506. When the cycle start pushbutton 508 is pressed, power is furnished between conductors 506 and 510 and CRA relay is turned on. CRA contact in line 17 now closes between conductors 506 and 510 to hold CRA relay energized. CRA causes the machine 210 to go into an automachine cycle by closing the contact in line 19 between conductors 478 and 512.

When the cycle starts, the head 406 is up and LS-1A is held closed. The ejector and pallet feet mechanism 340 is forward LS-8 is held closed, all in line 19. A pallet has been removed from the pallet magazine 330 so LS-7A is closed. The auxiliary pallet feeder 310 is back so LS-8 is held closed. The strip bar 426 is down at this point so CR-3 is closed, and power has been supplied from conductor 478 through conductors 512, 514, 516, 518, 520, 522; the pushbutton station is in its pocket so CRMA is closed and power is also being supplied to conductor 524 so the strip-up solenoid 526 is energized, and the strip-up pilot light 528 on the front of the cabinet (not shown) is "on", and the strip mechanism 392 is in its up motion.

When the strip mechanism 392 arrives at the up position, LS-1 is closed in line 23, CR-2 is closed in line 24. CR-4L is closed in line 24, power is supplied to conductor 530 and CR-1 relay is turned on. CR-1 locks itself in between conductors 530 and 532 through the feed drawer timer 534. CR-1 closes in line 31 between conductors 512 and 536, LS-2 in line 31 is closed so the power travels through conductor 538 through CRMA contact and to conductor 540 and the feed drawer "forward"solenoid 542 is turned on and the feed drawer pilot light 544 on the front of the cabinet.

The feed drawer 286 begins to move to the rear toward the moldbox 250. As the feed drawer 286 moves to the rear, it leaves LS-3 limit switch in line 46 and the power is removed from conductor 546 to turn "off" CR-2 relay. CR-2 normally closed contact goes closed in line 25 and turns on the power between conductors 512 and 548 to start the feed drawer time delay. The feed drawer 286 travels all the way to the rear and strikes LS-2 limit switch. LS-2 opens in line 31 between conductors 536 and 538 and closes in line 33 between conductors 536 and 550. With the feed drawer oscillation selector 552 in the on position, power will be furnished between conductors 550 and 554 and will travel through CRMA contact and to conductor 556 to operate the feed drawer "back" solenoid 558 and turn on the feed drawer back pilot light 560. The feed drawer 286 will travel back off of LS-2 releasing it. LS-2 will open in line 33 and close in line 31 and the feed drawer 286 will go forward again causing an oscillation motion, which will continue until the end of feed drawer time delay. At the end of feed drawer time delay, the feed drawer timer 534 opens the contact in line 27 and turns off CR-1 relay. CR-1 relay opens in line 31 between conductors 512 and 536 and closes in line 35 between conductors 512 and 554, which supplies power between conductors 512 and 554 through CRMA contact into conductors 556 and the feed drawer back solenoid 558 and feed drawer back pilot light 560 on the front of the cabinet is turned on and the feed drawer 286 is moved all the way to the forward position under chute 274.

In the previous discussion of the feed drawer 286, if the feed drawer oscillation switch 552 had been in off position, it would have jumpered in line 30 around LS-2 normally closed limit switch would have connected conductors 536 and 538 permanently so that the feed drawer 286 would have gone forward and stayed forward for the duration of the feed drawer time delay without performing its oscillation motion. At the end of feed drawer time delay, the feed drawer 286 would have returned to the forward position.

when CR-1 relay came on to bring the feed drawer 286 to the rear, it also will close a contact in line 71 between conductors 512 and 562 to start the vibrator start delay timer 564 in lines 70 and 71. After time delay, the vibrator start delay timer 564 will close in line 72 between timer terminals 566 and 568 to supply power to conductor 570, and if the auto-vibrator selector switch 527 is in the on position, then power is passed from conductor 570 to conductor 574 through CRMB contact, which is closed, into conductor 576 to turn on M-3 motor starter and run the vibrator motors 266. At the end of feed drawer time delay, CR-1 will be open in line 71, but by now the feed drawer 286 is to the rear, it is not on LS-3 limit switch. CR-2 is normally closed in line 70, supplying power to conductors 512 and 562 to keep the vibrator start delay timer 564 energized and the vibrator motors 266 running. If the auto-vibrator selector switch 572 was in the off position, the vibrator motors 266 would have remained deenergized and would not run. This feature is used for dry cycling the machine 210 without vibrators running only, and is not used for an automatic cycle.

At the same time that the CR-1 relay was turned on to bring the feed drawer 286 to the rear caused by the strip bar 426 coming up and closing LS-1 in line 23, and LS-1 normally closed limit switch opened in line 61 to turn off CR-3 and CR-3TD, CR-3 normally closed went closed in line 40 and supplied a circuit between conductors 512 and 578, through a CRMA contact into conductor 580 and turned on the ejector back solenoid 582 and ejector back pilot light 584 on the face of the cabinet. The same CR-3 contact supplies power between conductors 512 and 578 and in line 65. Conductor 578 supplies power to a CR-3D timer contact, which is closed when the relay is energized and opens after time delay after the relay is de-energized. This contact supplies power into conductor 586 and unlatches CR-10L relay. CR-10L relay normally closed contact in line no. 44 closes between conductors 512 and 588 and through a CRMB contact to conductor 590 and out to a LS-9 normally open limit switch. LS-9 normally open limit switch is a pallet magazine safety in the auxiliary pallet feeder. If a pallet is present in the auziliary pallet feeder hopper 312, LS-9 is held closed and power is supplied between conductors 590 and 592, and the pallet feeder forward solenoid 594 is energized, causing the auxiliary pallet feeder 310 to feed a new pallet into the pallet magazine 330. When the pallet is fed into the pallet magazine 330, it strikes the operating arm of LS-7A limit switch and when the ejector and pallet feed mechanism 340 returns to its rear position, LS-7 normally open limit switch is held closed in line 63. Now with LS-7 and 7A both held closed, the power is supplied from conductor 512 through conductor 596 to conductor 598 and CR-10L relay is latched again. CR-10L now closes normally open contact in line No. 42 between conductors 512 and 600 through CRMB contact and the pallet feeder back solenoid 602 is now energized to retract the auxiliary pallet feeder 310 and close LS-8A in line 19.

It is now evident that at the instant the feed drawer 286 moves to the rear, three major motions take place simultaneously; the feed drawer 286 moves forward, the ejector and pallet feed mechanism 340 moves to the rear, and the auxiliary pallet feeder 310 moves forward and then back. At the end of feed drawer time delay, the feed drawer 286 returns to the forward position as has previously been described. As the feed drawer 286 reaches the forward end of its stroke, it strikes LS-3 limit switch normally open in line 46 and closes LS-3 between conductors 480 and 546 to turn on CR-2 relay. CR-2 closes in line 47 between conductors 512 and 604, CR-1 relay is now deenergized, CR-4 relay is de-energized; and power is supplied through conductors 604 and 606 to conductor 608 through CRMA contact to conductor 610 and the head down full pressure solenoid 612 is energized to move the head 406 down onto the top of the moldbox 250 and simultaneously the head down pilot light 614 is lighted on the front of the cabinet. Conductor 608 also supplies power in line 50 through CR-3 normally closed contact, which is closed, into conductor 616 and the head down by-pass solenoid 618 is energized, along with the head down by-pass pilot light 620, to cause the head 406 to fal on top of the material for the sizing motion at no pressure. CR-2 contact in line 47 also supplies power through conductor 512 to conductor 622 and in line 51, conductor 622 supplies power through CR-4L normally closed contact to conductor 624 and consequently energizes the sizing transformer 626 supplying 24 volts to the sizing rods 450, 452. The head 406 is now down and vibrating at a selected pressure, the sizing motion is now taking place, and material is being vibrated to size.

At the point of sizing, the left and/or right sizing rods 450, 452 come together. At the point that both of them are together, they are grounded out to supply power in line 55 through conductors 628, 630, 632 and turn on SCR-1 relay. SCR-1 now closes in line 54 between conductors 628 and 632 to lock itself in. Before the sizing rods 450, 452 make contact, the left and right sizing rod lights 634 and 636 are connected in series and burning half bright, and if, for example, the left sizing rods should make contact first, it will cause a short circuit between conductors 628 and 630 and the left sizing rod light 634 will be shorted out and will go out. The right sizing rod light 636 will come on full bright indicating that the left sizing rods has made contact and the right sizing rods have not. If the right rods should make contct first, the right sizing rod light 636 will go out, and the left sizing rod light 634 will come on full bright.

SCR-1 relay is now turned on, it closes the contact in line 57 between conductors 512 and 638 to turn on the strip delay timer 640. The strip delay timer 640 is used to produce a short time delay to allow correction in shapes of the resilient blocks 430 on strip member 428 and to allow any error in the sizing rods caused by vibration to be corrected before the strip motion takes place. At the end of strip delay toime, CR-3 relay and CR-3TD relay are turned on in line 58 and 61. CR-3 relay opens a contact in line 50 between conductors 608 and 616 turning off the head down by-pass solenoid 618 and causing the head 406 to show full hydraulic pressure down. CR-3 also closes contact in line 63 between conductors 598 and 642 through CRMB contact into conductor 644 to turn on the strip down solenoid 646 and strip down pilot light 648 on the front of the cabinet, and the strip bar 426 and the head 406 now move down in the stripping motion removing the block from the moldbox 250. The strip bar 426 travels down until the head 406 reaches a level where the bottom of the head 406 is just clearing the bottom of the moldbox 250, at which point the head 406 closes LS-4 limit switch and supplies power to CR-4L relay in line 22 to latch CR-4L. CR-4L opens the contact in line 47 between conductors 606 and 608 to turn off the head down full pressure solenoid 612 and the head down pilot light 614. CR-4L closes the contact in line 76 between conductors 512 and 650 supplying power through conductor 650 and CRMB contact to conductor 652 turning on the head up solenoid 654 and the head up pilot light 656 on the front of the cabinet. The head 406 now travels up until it closes LS-1A limit switch and reaches the full extent of its up travel. LS-1A closes in line 19. When the strip mechanism 392 started down, it left LS-1 limit switch, and LS-1 normally closed in line 61 went closed to supply power between conductors 512 and 658 and to hold CR-3 and CR-3TD energized, even through the strip delay timer 640 is turned off. CR-4L opened a contact in line 51 between conductors 622 and 624 to turn off the sizing transformer 626, the sizing rod lights 634 and 636, SCR-1 and the strip delay timer 640. When CR-3 was turned on by the strip delay timer 640, it opened a normally closed contact in line 67 between conductors 660 and 662 to turn off the vibrator 572 started and stop the vibration of the moldbox 250. Motor starter M-3 dropped out and closed a normally closed contact in line 74, CR-1 relay is out so its contact is closed in line 74 and power is supplied between conductors 512, 674 and 676 to turn on the vibration brake solenoid 678 and the vibrator brake pilot light 680 on the front of the cabinet.

The strip mechanism 392 now continues its travel down until it reaches the bottom of the stroke and operates LS-6 limit switch. LS-6 goes closed in line 38 between conductors 682 and 684 and if there is room on the runout conveyor 380 for the next loaded pallet coming off the ejector element 372, LS-5 will be closed, CR-3 is closed, CR-10L is closed, CRMA is closed, so power is supplied between conductors 512, 682, 684, 686, 688, 690 and into conductor 692 to turn on the ejector forward solenoid 694 and ejector forward pilot light 696. The next cycle is now started.

LS-5 is a safety switch and is a normally closed limit switch located in the runout conveyor 380 just forward of the ejector element 372, and is used to detect the presence of a pallet, which would indicate no room for a pallet to come off the ejector element 372. The runout conveyor 380 is run by the runout hydraulic valve solenoid 698 shown in line 78. A jumper 700 is shown in line 78 between conductors 512 and 702 and can be removed and the interlock from an automatic loader-unloader (not shown) connected across conductors 512 and 702 terminals for serving to turn off the runout solenoid 698 and runout light 703 and stop the runout conveyor 380 in case of a jam-up in the loader-unloader. If no interlock is used, the jumper must be on the terminal between conductors 512 and 702 and the runout solenoid will be energized any time the machine 210 is in cycle.

The hydraulic accumulator solenoid 704 in line 80 in between conductors 512 and 706 is energized any time the machine 210 is in cycle and CRA relay is on. The accumulator solenoid is used to lock hydraulic pressure into the accumulator when the pump is turned off, but when the cycle is turned on, the hydraulic accumulator solenoid is turned on and connects the accumulator to the main pressure line.

Anytime the machine 210 is running in automatic cycle with CRA energized, the normal cycle selector switch 500 shown in line 16 must be in the on position for continuous running. The normal cycle selector switch 500 is used to achieve a normal stop in the automatic cycle. During the cycle, if the normal cycle selector switch 500 is turned to the off position, it will open between conductors 498 and 502, but with the strip up, LS-6 will be closed between conductors 498 and 502 and the automatic cycle will continue until such point as the strip mechanism 392 is down. When the strip mechanism 392 reaches the bottom, LS-6 will open between conductors 498 and 502 in line 17 and turn off CRA relay stopping the machine 210 in a normal cycle stop position. The cycle stop pushbutton 504 will turn off CRA relay any time, any place, to stop the cycle but will leave the hydraulic pump and the fan, if used, running. Emergency stop pushbutton 708 in line 10 will freeze the machine 210 in its position at the moment turning off the pump motor starter, the fan motor starter — is used, CRA relay and all control power to the entire machine.

For manual control of the machine 210, the rear sound insulation panels 232 and 234 must be open, which will open SS-1 safety limit switch in line 16 and turn off CRA relay if it has not already been turned off. Then the pushbutton station must be removed from its hang-up pocket within the enclosure 240, which will open LS-10 limit switch in line 13 and turn off CRMA and CRMB relays and turn off the auto-ready pilot light 488 on the front of the cabinet. CRMA would then open its contacts in lines 16, 19, 31, 33, 38, 40 and 47. CRMB would open its contacts in lines 42, 63, 67, 76, 78 and 44. CRMA normally closed contact would go closed in line 20 supplying power to conductor 710 and the manual safety pushbutton 712. The manual safety pushbutton 712 is located in the manual pushbutton station and is a so called dead-man switch. It must be held closed before any manual controls will take place. With the manual safety switch held closed, it supplies power between conductors 710 and 714 to operate all manual pushbuttons. The strip up may be operated by closing the strip up pushbutton 716 in line 20 between conductors 714 and 524. Feed drawer rearward manual pushbutton 718 may be operated to bring the feed drawer 286 to the rear in manual by closing the pushbutton 718 in line 32 and supplying power between conductors 714 and 720. Feed drawer forward solenoid 558 may be operated by closing the feed drawer forward pushbutton 722 in line 34 and supplying power between conductors 714 and 724. Ejector and pallet feed mechanism forward may be operated manually by closing the ejector mechanism forward pushbutton 726 in line 39 and supplying power between conductors 714 and 728. The ejector and pallet feed mechanism back may be operated manually by holding both the strip up pushbutton 716 in line 20 and the ejector back 730 pushbutton in line 41. The strip up pushbutton in line 20 will supply power between conductors 714 and 524. The power in conductor 524 will then travel to the ejector back pushbutton 730 in line 41 and the ejector back pushbutton 730 will supply power between conductors 524 and 580 to turn on the ejector back solenoid 582. This interlock with strip up is used to prevent damage to the ejector and pallet feed mechanism 340 caused by running it back when the strip mechanism 392 is down. The auxiliary pallet feeder back may be operated by pushing the auxiliary pallet feeder back pushbutton 732 in line 43 and supplying power between conductors 714 and 734. The auxiliary pallet feeder forward may be operated manually by pushing the pallet feeder forward pushbutton 736 in line 45 and supplying power between conductors 714 and 590, but the pallet feeder forward solenoid 594 will only be energized if a pallet is present in the auxiliary pallet feeder hooper 312 holding LS-9 closed and supplying power between conductors 590 and 592.

The head down may be operated manually by pushing the head down pushbutton 738 in line 48, but will operate only if the feed drawer 286 is forward resting on LS-3 in line 46, which in turn holds CR-2 relay on. CR-2 will close the contact in line 48 between conductors 714 and 740, and supply power via conductor 740 to the head down pushbutton 738, then to conductor 610, and the head 406 will travel down manually. This same CR-2 contact in line 48 supplying power between conductors 714 and 740 also supplies power through the conductor 740 to the strip down manual pushbutton 742 in line 62. Pressing the strip down manual pushbutton 742 will supply power between conductors 746 and 644, and the strip mechanism 392 will travel down, but only if the feed drawer 286 is forward resting on LS-3. Vibrator jog pushbutton 744 in line 68 may be pushed to close between conductors 714 and 576 to turn on the vibrator starter and job the vibrator motors. The head 406 may be run up in manual by pushing the head up pushbutton 746 in line 77 and closing contact between conductors 714 and 652, and the head 406 will travel up. The runout solenoid 698 may be jogged by pushing the runout pushbutton 748 in line 79 and supplying power between conductors 714 and 750 to turn on the runout solenoid 698. The manual sizing pushbutton 752 shown in line 54 and located on the front of the cabinet just above the sizing rod pilot lights may be operated any time, so that the machine 210 does not have to be in manual mode for this pushbutton to operate. It is used in case something happens to prevent the sizing rods from coming together in an automatic cycle, such as a heavy piece of foreign material under the head 406. This pushbutton 752 will cause the machine to size out artifically and continue on in an automatic cycle.

Header block selector switch 754, shown in lines 37 and 38, when in the off position will cause the cycle to function as previously described. When the header block selector switch 754 is turned to the on position, the cycle is as exactly as previously described except that the ejector and feeder mechanism 340 will not come forward until the head 406 has reached its up position and is holding LS-1A limit switch closed in line 19 to supply power between conductors 512 and 514. Then the header block selector switch 754 being in the on position will supply power between conductors 514 and 682 delaying the operation of the ejector and pallet feeder mechanism forward until LS-1A is closed in line 19.

The remaining circuits pertain only to the quality controls and have no effect on the automatic cycle of the machine, because the quality control is used only as an indicator and not a controller. The Speedex clock 756 in line 83 indicates the total cycle time and the 8″ equivalent rate of production per hour of concrete blocks. The sizing time clock 758 shown in line 86 indicates the time it takes to size the block from the instant the head 406 falls until CR-3 is turned on at the end of strip delay time. Vibrator clock 760 shown on line 89 indicates the total time the vibrator runs, including the feed time and sizing time. CR-5 relay in line 92 is a so-called flip-flop relay. Its contact shown in line 83 normally open closes every other time the CR-5 coil is energized. In other words, it alternates — one time on — one time off. Manual timer 762 shown in line 83 between conductors 764 and 706 is a manual timer used to turn on the Speedex clock 756, the sizing time clock 758, and the vibrator clock 760 so they may be read for a period of time and will remain reading until the manual timer 762 times out, at which time they will be turned off. The quality control selector switch 766 shown in line 94 and 95, when in the off position will supply power between conductors 480 and 768 to turn on the quality control off pilot light 770 on the front of the control cabinet. When in the on position, it will supply power between conductors 480 and 772 and when CR-2 relay comes on when the feed drawer 286 reaches the forward end of its stroke, will supply power between conductors 772 and 774 to the sizing timer 776. Sizing timer 776 is set for the amount of time-delay required as indicated by the sizing time clock 758 to give the proper quality and compactness of the concrete block. After time-delay the sizing timer 776 turns on CR-6 relay in line 97. As the sizing rods 450, 452 come together turning on SCR-1 and the strip delay timer 640 times out turning on CR-3, before CR-6 is turned on, then CR-6 will remain normally closed in line 101 and power will be supplied between conductors 774, 776 and 780 to turn on CR-7 relay. If CR-6 comes on before the strip delay timer 640 turns on CR-3 and CR-3 opens in line 102, then power will be supplied through conductors 774, 782 and 780 to turn on CR-7 relay. CR-7 relay will close contact in line 105 between conductors 774 and 784 to turn on the tolerance timer 786. Tolerance timer 786 is used as a fixed time-delay to introduce an allowable tolerance in variation in the sizing time of the block. After time-delay of the tolerance timer 786, the tolerance timer 786 closes the contact between its terminal 788 and terminal 790 to supply power between conductors 784 and 792. After tolerance time-delay, if CR-3 is still closed and CR-6 is still not open in line 107, then power will be supplied between conductors 792, 794 and 796 to turn on CRA relay and the feed time-too-short pilot light 798 on the front of the cabinet. CR-8 will close its own contact in line 108 and lock itself in between conductors 792 and 796. If CR-6 closed and CR-3 did not open, and remained that way after tolerance time, then power will be supplied in line 109 between conductors 792, 800 and 802 to turn on CR-9 relay and feed-time-too-long pilot light 804 on the front of the cabinet. CR-9 will close its own contact and lock itself in between conductors 792 and 802. Once CR-8 or CR-9 is locked in lines 108 and 110, they will remain locked in until CR-2 relay opens in line 95 to remove all power. This resets the quality control for the next cycle of the machine.

I claim:

1. In a block molding machine, a frame, a moldbox open at the top and bottom supported by the frame, material feed means located above said moldbox for feeding material into said moldbox, vibration means supported by said frame for vibrating said moldbox for compressing and sizing a block in the moldbox, a strip mechanism mounted on said frame for supporting a pallet under said moldbox, a head assembly mounted on said frame for compressing material in said moldbox during vibrational movement of the moldbox, said strip mechanism and said head assembly each having separate and independent actuating means, said actuating means being structurally interconnected for (1) raising said head assembly relative to said strip mechanism an amount sufficient to enable feeding of material into said moldbox by said material feed means, (2) subsequently holding said head assembly and said strip mechanism rigidly together as a unit when a block has been sized in the moldbox and (3) lowering said head assembly and strip mechanism simultaneously while holding them rigidly together as a unit for stripping the block from the moldbox.

2. In a block molding machine, the combination that is defined in claim 1, wherein said actuating means includes a head cylinder connected at one end to said head assembly and at the other end to said strip mechanism for selectively imparting relative movement between said head assembly and said strip mechanism or holding said head assembly and strip mechanism together as a unit, and a strip cylinder connected between said strip mechanism and said frame for moving said strip mechanism.

3. In a block molding machine, the combination that is defined in claim 1, wherein said strip mechanism includes a strip guide mounted for vertical movement on said frame, said head assembly includes a head guide mounted for vertical movement on said frame and located in vertical alignment above said strip guide, and said strip and head guides have block sizing control means mounted thereon, said sizing control means including associated control elements responsive to their proximity for signalling when a block in said moldbox has been properly sized during vibration of said moldbox.

4. In a block molding machine, the combination that is defined in claim 1, wherein said strip mechanism includes a pallet lifting member for engaging a pallet positioned under said moldbox, said actuating means associated with said strip mechanism being operably connected to said frame for raising said pallet lifting member and said pallet and thereby said moldbox from its support on said frame during vibration of said moldbox, said pallet lifting member including an elastomeric member for lifting engagement with said pallet.

5. In a block molding machine, the combination that is defined in claim 4, wherein time-delay means are provided in association with the strip mechanism actuating means, said time-delay means being operable following vibration of said moldbox to delay the actuation of the actuating means for lowering said head assembly and strip mechanism as a unit for a time sufficient to assure that the elastic properties of said elastomeric member have restored the elastomeric member generally to its original configuration.

6. In a block molding machine, the combination that is defined in claim 1, wherein said strip mechanism includes a strip guide mounted for vertical movement on each side of said frame, said head assembly includes a head guide mounted for vertical movement on each side of said frame and located in vertical alignment above the associated strip guide on that side of the frame, said frame having two vertical rows of rollers on each side between which the strip guides and the head guides are positioned for vertical movement.

7. In a block molding machine, the combination that is defined in claim 6, wherein said rollers have flexible treads.

8. In a block molding machine, a frame, a moldbox open at the top and bottom supported by the frame, material feed means located above said moldbox for feeding material into said moldbox, vibration means supported by said frame for vibrating said moldbox for compressing and sizing a block in the moldbox, a strip mechanism mounted on said frame for supporting a pallet under said moldbox, a head assembly mounted on said frame for compressing material in said moldbox during vibrational movement of the moldbox, said strip mechanism and said head assembly each having actuating means, said actuating means being operably interconnected for (1) raising said head assembly relative to said strip mechanism an amount sufficient to enable feeding of material into said moldbox by said material feed means, (2) subsequently holding said head assembly and said strip mechanism together as a unit when a block has been sized in the moldbox and (3) lowering said head assembly and strip mechanism as a unit for stripping the block from the moldbox, said actuating means including a head cylinder connected between said head assembly and said strip mechanism for selectively imparting relative movement between said head assembly and said strip mechanism or holding said head assembly and strip mechanism together as a unit and a strip cylinder connected between said strip mechanism and said frame for moving said strip mechanism, a knuckle joint having pivotally connected upper and lower links defining a knuckle connected between said frame and said strip mechanism, said lower link being pivotally connected at its remote end to said frame and said upper link being connected at its remote end to said strip mechanism, and said strip cylinder being connected to the strip mechanism by being pivotally connected to the knuckle of the knuckle joint, said strip cylinder and said knuckle joint being arranged so that when the strip cylinder is at one end of its movement the upper and lower links will be extended substantially in alignment for holding the strip mechanism in its uppermost position.

* * * * *

UNITED STATES PATENT OFFICE

CERTIFICATE OF CORRECTION

Patent No. 4,035,124 Dated July 12, 1977

Inventor(s) Milo G. Balhorn

It is certified that error appears in the above-identified patent and that said Letters Patent are hereby corrected as shown below:

Column 3, line 68, "of" should be --or--.

Column 6, lines 17 and 18, "installation" should read --insulation --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*